US011603777B2

(12) United States Patent
Miyauchi et al.

(10) Patent No.: US 11,603,777 B2
(45) Date of Patent: Mar. 14, 2023

(54) INTERNAL COMBUSTION ENGINE

(71) Applicant: Mazda Motor Corporation, Hiroshima (JP)

(72) Inventors: Yuma Miyauchi, Aki-gun (JP); Runa Suzuki, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 17/723,749

(22) Filed: Apr. 19, 2022

(65) Prior Publication Data

US 2022/0381162 A1 Dec. 1, 2022

(30) Foreign Application Priority Data

May 25, 2021 (JP) ..... JP2021-087816

(51) Int. Cl.
*F01L 1/053* (2006.01)
*F01M 9/10* (2006.01)
*F01L 1/047* (2006.01)

(52) U.S. Cl.
CPC ..... *F01L 1/053* (2013.01); *F01M 9/102* (2013.01); *F01L 2001/0476* (2013.01); *F01L 2001/0537* (2013.01)

(58) Field of Classification Search
CPC ..... F01L 2001/0476; F01L 1/053; F01L 2001/0537
USPC ..... 123/90.27, 90.34
See application file for complete search history.

(56) References Cited

U.S. PATENT DOCUMENTS

2018/0087644 A1* 3/2018 Meusel ..... F01L 1/047

FOREIGN PATENT DOCUMENTS

DE 102019204831 A1 * 10/2020
JP 2021025653 A 2/2021

* cited by examiner

*Primary Examiner* — Jorge L Leon, Jr.
(74) *Attorney, Agent, or Firm* — Alleman Hall Creasman & Tuttle LLP

(57) ABSTRACT

An internal combustion engine is provided, which includes an engine body provided with a cylinder having openings for intake and exhaust, and valve bodies that open and close the openings, cam shafts, each provided with a cam lobe that depress the corresponding valve body to open the openings, and bearing members pivotally supporting the cam shaft via lubricating oil. The cam shaft includes cam journals pivotally supported by the bearing members, and a recess formed at a position of the cam journal, opposing the cam lobe in the circumferential direction, and depressed radially inwardly of the cam journal, the recess being deeper in an axial end part of the cam journal than an axial center part.

16 Claims, 15 Drawing Sheets

INTERNAL COMBUSTION ENGINE

TECHNICAL FIELD

The present disclosure relates to an internal combustion engine having a structure in which a cam journal of a cam shaft is pivotally supported by a bearing member via lubricating oil.

BACKGROUND OF THE DISCLOSURE

Internal combustion engines are provided with cam shafts which operate an intake valve for opening and closing an intake port of the cylinder, and an exhaust valve for opening and closing an exhaust port. The cam shafts are provided with a cam lobe which depresses a stem end of the intake valve or the exhaust valve, and a cam journal used as a part pivotally supported by a bearing member of a cylinder head. The cam journal is pivotally supported by a slide bearing via lubricating oil. Although it is a crank journal used as a pivotally-supported part of a crankshaft, JP2021-025653A discloses an internal combustion engine in which a plurality of recesses are provided in an outer surface of the crank journal to increase the retention of lubricating oil.

Meanwhile, in order to improve the fuel efficiency of the internal combustion engine, various kinds of mechanical losses need to be reduced. Further, in terms of suppressing friction loss of the sliding surface, it is desirable to use low-viscosity oil as the lubricating oil. However, when the low-viscosity oil is used, poor lubrication may occur in the bearing part of the cam journal, and therefore, wear may occur at the cam journal. Further, since a load is applied to the cam shaft in a direction which intersects with the axial direction when the cam lobe depresses the intake valve or the exhaust valve, a deforming force acts on the cam shaft. Therefore, the occurrence of the wear due to the deformation of the cam journal itself also poses a problem.

SUMMARY OF THE DISCLOSURE

One purpose of the present disclosure is to provide an internal combustion engine capable of suppressing wear of a cam journal accompanying a deformation of a cam shaft, while maintaining lubrication in a bearing part of the cam journal.

According to one aspect of the present disclosure, an internal combustion engine is provided, which includes an engine body provided with a cylinder having openings for intake and exhaust, and valve bodies that open and close the openings, cam shafts, each provided with a cam lobe that depresses the corresponding valve body to open the openings, and bearing members pivotally supporting the cam shaft via lubricating oil. Each cam shaft includes cam journals pivotally supported by the bearing members, and a recess formed at a position of the cam journals, opposing the cam lobe in the circumferential direction, and depressed radially inwardly of the cam journals, the recess being deeper in an axial end part of the cam journals than an axial center part.

When the cam lobe depresses the valve body, the depressing load of the valve body acts on the cam shaft. The depressing load is a load in a direction which intersects with the axial direction of the cam shaft, and which deforms the part of the cam lobe to the other side from the depressing direction of the valve body. The cam shaft includes the cam journal which pivotally supports the cam shaft. Thus, the deforming force resulting from the depressing load acts in such a direction that the circumferential surface of the cam journal is brought closer to the bearing member. That is, at the position opposing the cam lobe in the circumferential direction, a state in which the circumferential surface of the cam journal is easily able to contact the bearing member is formed.

According to this configuration, the recess is formed at the position opposing the cam lobe in the circumferential direction, and is deeper in the axial end part of the cam journal than the axial center part. Thus, even if the depressing load of the valve body is applied to the cam shaft, at the position opposing the cam lobe in the circumferential direction, the recess can secure a clearance between the circumferential surface of the cam journals and the bearing members, and therefore, the contact therebetween can be avoided. On the other hand, in an area where the recess is not formed, the clearance between the circumferential surface of the cam journals and the bearing members can be set small. Therefore, even if low-viscosity oil is used as lubricating oil, the oil is unlikely to leak, thereby securing lubrication. Therefore, it is possible to achieve both lubrication retention in the bearing members of the cam journals, and wear prevention of the cam journals.

For each cam shaft, the recess may become gradually deeper from the axial center part of the cam journals toward the axial end part.

When the depressing load of the valve body acts on the cam shaft, at the position opposing the cam lobe in the circumferential direction, the axial end part of the cam journal is deformed in a direction closest to the bearing member, and the deformation decreases as it goes toward the axial center. According to this configuration, the recess can have a depth distribution that matches with such a deformation mode of the cam journal, which achieves the securing of lubrication and wear prevention more suitably.

For each cam shaft, the recess may have a given axial width and a given circumferential width in the axial direction and in the circumferential direction of the cam journals, and the axial width of the recess may be wider on an upstream side in the rotational direction of the cam shaft than on a downstream side.

In particular, for each cam shaft, a plan view shape of the recess in a plane shape in which the cam journals are developed in the circumferential direction may have a bulged part that is bulged toward the axial center part with a tight curve near an upstream end in the rotational direction of the circumferential width, and a gradual-curve part that extends from the bulged part with a gradual curve to a downstream end in the rotational direction of the circumferential width.

The present inventors' analysis reveals that there is a tendency in which the depressing load of the valve body is larger at the upstream side in the rotational direction of the cam shaft than the downstream side, at the position opposing the cam lobe in the circumferential direction. In more detail, it is found that the largest load is applied to near the upstream end in the rotational direction, and the load decreases gradually as it goes toward the downstream end in the rotational direction. According to this configuration, the recess can have the axial width which meets such a load tendency, and the contact of the cam journals with the bearing members can be certainly prevented.

The cylinder may be one of a plurality of cylinders, each of the cylinders being provided with two openings for intake and two openings for exhaust. Each of the cam shaft for intake and the cam shaft for exhaust may include a first valve body and a second valve body that open and close the two openings for intake and the two openings for exhaust, respectively, as the valve bodies. Each cam shaft may include a first cam lobe and a second cam lobe that depress the first valve body and the second valve body, respectively. One of the cam journals may be disposed at a position between the first cam lobe and the second cam lobe.

According to this configuration, since one of the cam journals is disposed at the position between the first cam lobe and the second cam lobe, the recess is formed in the cam journal, at each of the position opposing the first cam lobe in the circumferential direction and the position opposing the second cam lobe in the circumferential direction. Therefore, even if the cam shaft is applied with the depressing load which is received at each of the first cam lobe from the first valve body and the second cam lobe from the second valve body, the clearance between the circumferential surface of the cam journals and the bearing members can be secured by each recess.

The cylinder may be one of a plurality of cylinders, each of the cylinders being provided with two openings for intake and two openings for exhaust. Each of the cam shaft for intake and the cam shaft for exhaust may include a first valve body and a second valve body that open and close the two openings for intake and the two openings for exhaust, respectively, as the valve bodies. Each cam shaft may include a first cam lobe and a second cam lobe that depress the first valve body and the second valve body, respectively. The cam journals may include a pair of cam journals disposed so as to sandwich the first cam lobe and the second cam lobe.

According to this configuration, the depressing load received at the first cam lobe from the first valve body is applied to one of the pair of cam journals, and the depressing load received at the second cam lobe from the second valve body is applied to the other cam journal. Even if these depressing loads are applied, the clearance between the circumferential surfaces of the pair of cam journals and the bearing members can be secured by each recess.

The plurality of cylinders may be lined up in a given arrangement direction. The cam shafts may be disposed so as to extend in the arrangement direction. For each cam shaft, the recess may be formed only on the opposite side of the first cam lobe or the second cam lobe in an end cam journal located at one end side in the arrangement direction among the cam journals.

In the mode where the pair of cam journals are disposed so as to sandwich the first cam lobe and the second cam lobe, as for the end cam journal located at one end side in the arrangement direction, the cam lobe only exists axially inward of the cam journal. According to this configuration, as for the end cam journal located at the end of the cam shaft, the recess is formed at only the side opposing the first cam lobe or the second cam lobe. Therefore, the clearance is not unnecessarily formed between the cam journals and the bearing members, and both the securing of lubrication and prevention of the wear of the cam journals can be achieved.

DETAILED DESCRIPTION OF THE DISCLOSURE

Hereinafter, an internal combustion engine according to one embodiment of the present disclosure is described in detail with reference to the accompanying drawings. In this embodiment, an engine which is mounted on a vehicle, such as an automobile, as a power source for propelling the vehicle is illustrated as one example of the internal combustion engine.

Engine Structure

Figure 1:
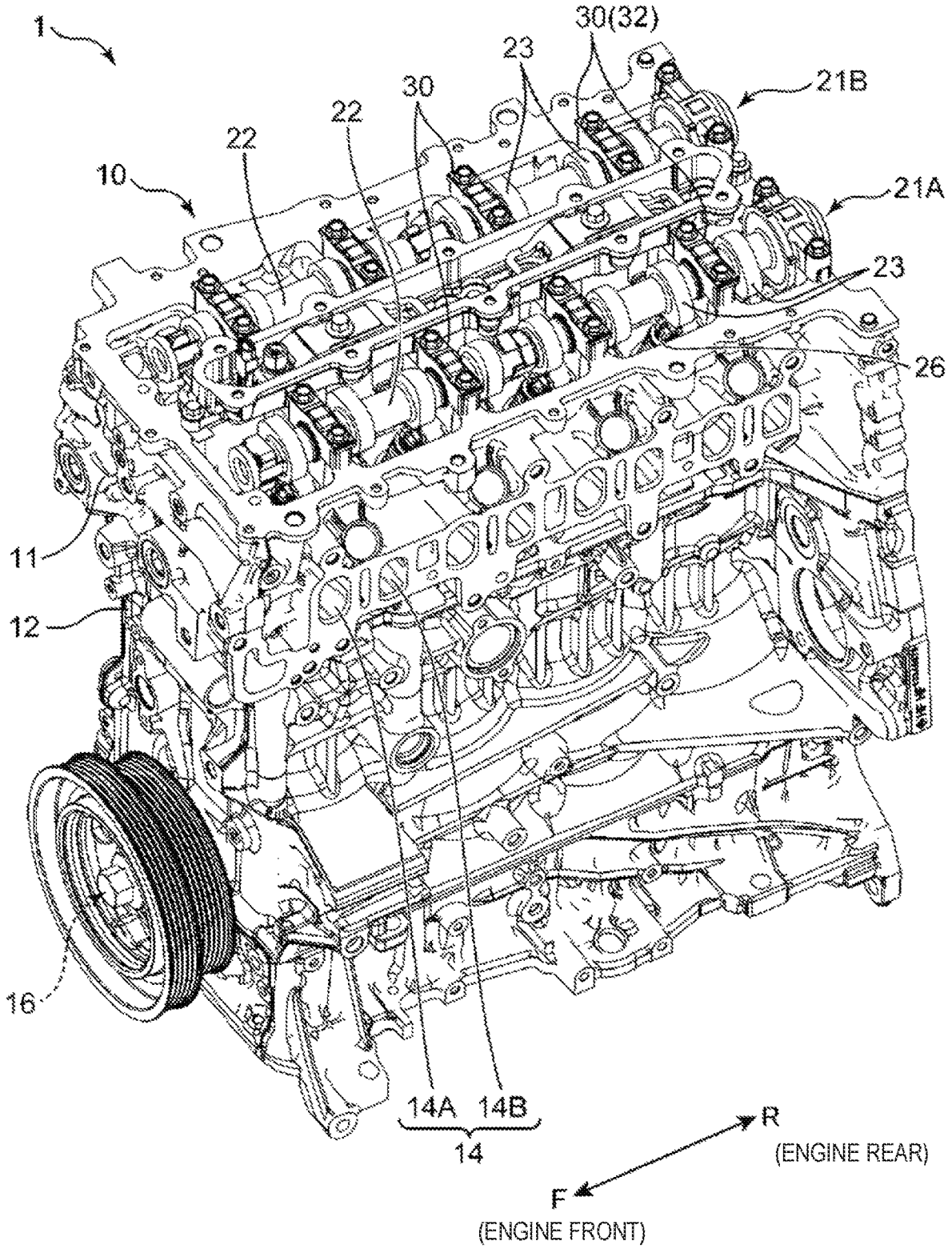
FIG. 1 is a perspective view illustrating the appearance of an engine which is one example of an internal combustion engine according to the present disclosure.
Figure 2:
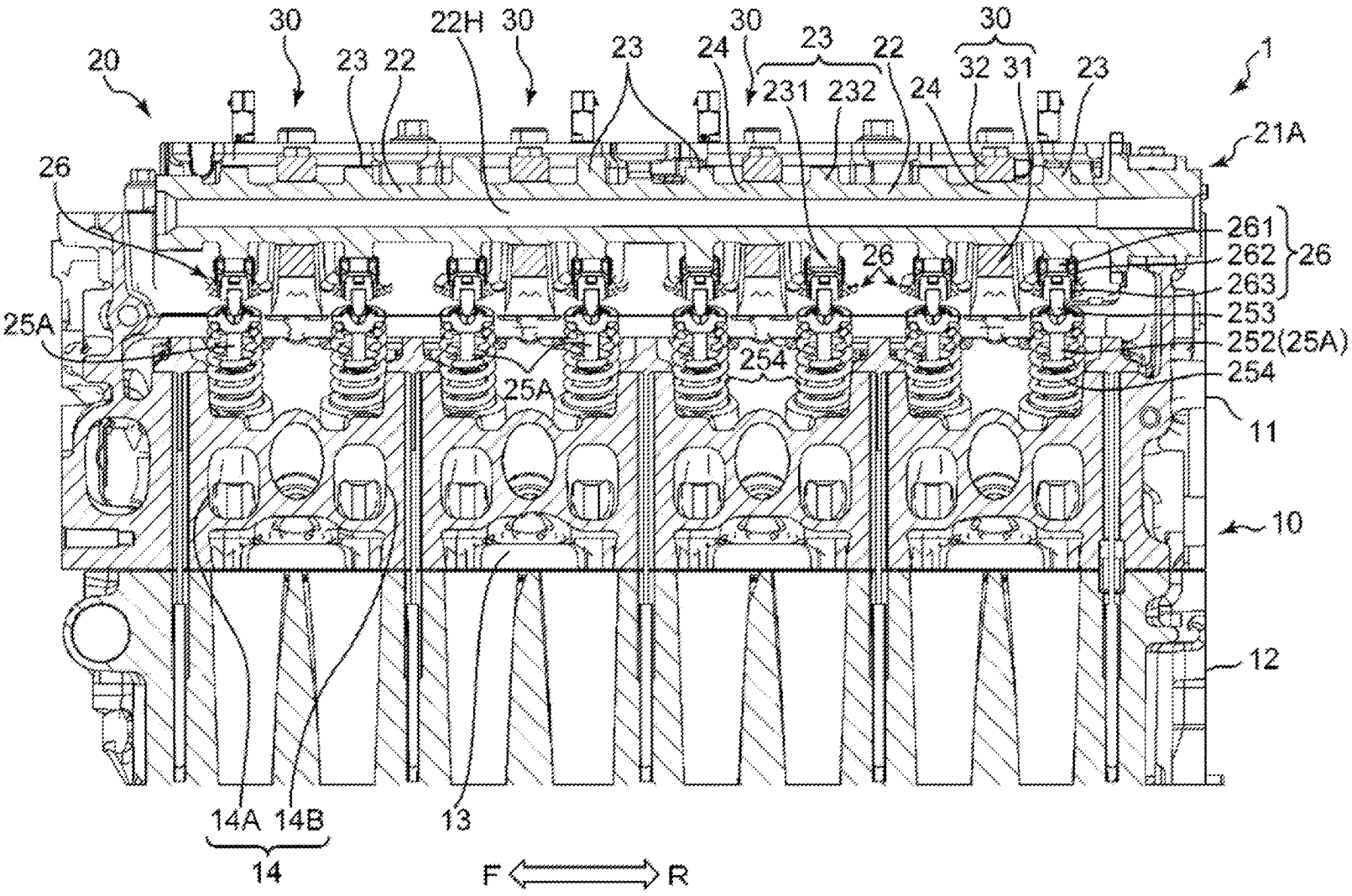
FIG. 2 is a longitudinal cross-sectional view in a cylinder lined-up direction of the engine, including a cross section of a valve operating mechanism provided to the engine.
Figure 3:
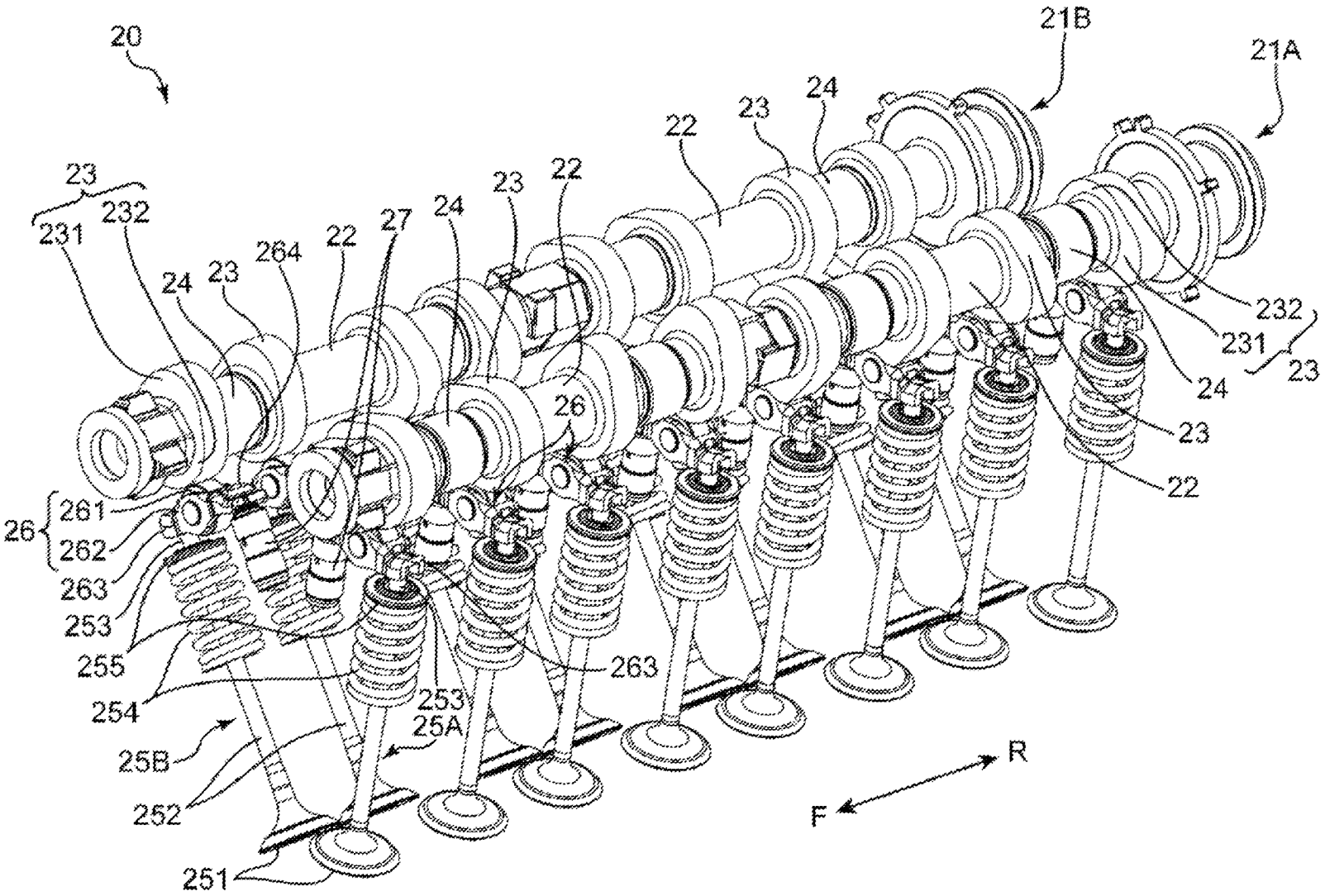
FIG. 3 is a perspective view of the valve operating mechanism.

FIG. 1 is a perspective view illustrating the appearance of an engine 1 according to this embodiment. The engine 1 is a four-stroke, in-series four-cylinder engine. In FIG. 1 and some other drawings, directional indications of "F" and "R" which respectively indicate "forward" and "rearward" of the engine 1 are given. The engine 1 includes an engine body 10, and a valve operating mechanism 20 incorporated into an upper part of the engine body 10. FIG. 2 is a longitudinal cross-sectional view in the cylinder lined-up direction of the engine 1, including a cross section of the valve operating mechanism 20. FIG. 3 is a perspective view of the valve operating mechanism 20.

The engine body 10 includes a cylinder block 11 and a cylinder head 12. The cylinder block 11 has four cylinders 13 lined up in the engine front-and-rear direction F-R (given arrangement direction). A piston is reciprocatably accommodated inside each cylinder 13. The cylinder block 11 may include more cylinders 13, and, for example, it may be for an in-series six-cylinder engine. Further, a crankshaft 16 which converts reciprocating movement of the piston into rotational movement is disposed inside a lower part of the engine body 10.

The cylinder head 12 is attached to an upper surface of the cylinder block 11, and closes an upper opening of the cylinder 13. In the cylinder head 12, intake ports 14 for taking intake air into the cylinders 13, and exhaust ports (which do not appear in FIGS. 1 and 2) are formed. Each cylinder 13 is connected to an intake system and an exhaust system in a four-valve type of two intake valves and two exhaust valves. In FIGS. 1 and 2, four pairs of intake ports 14, each pair being comprised of a first intake port 14A and a second intake port 14B, are lined up in the cylinder arrangement direction.

The cylinder head 12 is provided with intake valves 25A (valve bodies) which open and close intake ports 14, and exhaust valves 25B (valve bodies) which open and close exhaust ports. The valve operating mechanism 20 is attached to an upper surface of the cylinder head 12. A cylinder head cover (not illustrated) is attached to the upper surface of the cylinder head 12 so as to cover the valve operating mechanism 20.

The valve operating mechanism 20 is a mechanism which drives the intake valves 25A and exhaust valves 25B to open and close the intake ports 14 and the exhaust ports. The valve operating mechanism 20 drives the intake valves 25A and the exhaust valves 25B in an interlocking manner with the rotation of the crankshaft. By this drive, a valve head 251 of each intake valve 25A opens and closes a port opening 14H (see FIG. 4) of the corresponding intake port 14. Operation is similar for the exhaust valves 25B.

The intake valve 25A (the exhaust valve 25B) is a poppet type valve, and includes the valve head 251 which actually opens and closes the intake port 14 (the exhaust port), a stem 252 extending upwardly from the valve head 251, and a stem end 253 which is an upper end of the stem 252 and receives a depressing force from the valve operating mechanism 20. A valve spring 254 is fitted onto the stem 252. One end of the valve spring 254 contacts and is stopped by a spring seat 255 fixed to the stem 252.

Details of Valve Operating Mechanism

Next, the detailed structure and operation of the valve operating mechanism 20 are described. The valve operating mechanism 20 includes a cam shaft 21A for the intake valves and a cam shaft 21B for the exhaust valves, roller rocker arms 26, lash adjusters 27, and bearing members 30 which pivotally support the cam shafts 21A and 21B via lubricating oil. The cam shaft 21A for the intake valves and the cam shaft 21B for the exhaust valves are coupled to the crankshaft 16 through a chain or a belt, and are rotated on the axis in the interlocked manner with the rotation of the crankshaft 16.

The cam shaft 21A for the intake valves is disposed above eight intake valves 25A lined up in series. Similarly, the cam shaft 21B for the exhaust valves is disposed above eight exhaust valves 25B lined up in series. Each of the cam shaft 21A for the intake valves and the cam shaft 21B for the exhaust valves includes a shaft body 22, cams 23, and cam journals 24. The shaft body 22 extends straightly in the engine front-and-rear direction F-R, with a length corresponding to the arrangement length of the intake valves 25A or the exhaust valves 25B. Inside the shaft body 22, a hollow bore 22H extending in the axial direction of the cam shaft 21A or 21B is formed for the purpose of circulating cooling oil or reducing the weight.

The cams 23 are disposed on the shaft body 22 at locations corresponding to the respectively disposed locations of the eight intake valves 25A or the eight exhaust valves 25B. Each cam 23 has a cam lobe 231 and a base circle 232. The cam lobe 231 is a major-axis part of the cam 23, and it depresses the intake valve 25A or the exhaust valve 25B via the roller rocker arm 26 to open the intake port 14 or the exhaust port. Note that the valve operating mechanism may be of a direct acting type in which the cam lobe 231 directly depresses the intake valve 25A or the exhaust valve 25B, without the intervention of the roller rocker arm 26. The base circle 232 is a minor-axis part of the cam 23, and has a larger dimension than the diameter of the shaft body 22.

The cam journal 24 is a part where the cam shaft 21A or 21B is pivotally supported by the bearing member 30. The cam journal 24 is formed slightly larger in the diameter than the shaft body 22, and is disposed at an area close to the cam 23. In this embodiment, one cam journal 24 is disposed between a pair of cams 23 disposed corresponding to one cylinder 13.

The roller rocker arm 26 is a member which transmits the depressing force of the cam 23 to the intake valve 25A or the exhaust valve 25B by utilizing the principle of leverage, and is disposed at each of the eight cams 23. The roller rocker arm 26 includes a roller 261 which contacts the circumferential surface of the cam 23, and a swing arm 262 which pivotally supports the roller 261. A contact part 263 which depresses the stem end 253 of the intake valve 25A or the exhaust valve 25B is formed at one end side of the swing arm 262. At the other end side of the swing arm 262, a pivot part 264 used as a fulcrum of the pivot of the swing arm 262 is formed.

The lash adjuster 27 automatically adjusts a valve clearance between the stem end 253 and the contact part 263. As the lash adjuster 27, a hydraulic lash adjuster utilizing oil pressure of the engine oil can be used. When the valve clearance increases due to the wear, etc., the lash adjuster 27 increases an amount of oil stored therein to reduce the valve clearance.

The bearing member 30 pivotally supports each cam journal 24 of the cam shafts 21A and 21B via lubricating oil. The bearing member 30 includes a head-side bearing 31 and a cam cap 32. The cam journal 24 is held by a pivotal support created by the engagement of the head-side bearing 31 and the cam cap 32. The head-side bearing 31 is a bearing part formed integrally with the cylinder head 12, and pivotally supports an annular circumferential surface in the lower half of the cam journal 24. The cam cap 32 is a member provided with a semicircular bearing part which pivotally supports an annular circumferential surface in the upper half of the cam journal 24, and is fixed to the head-side bearing 31 with bolts, etc. Lubricating oil is supplied between the inner circumferential surface of the head-side bearing 31 and the cam cap 32 and the outer circumferential surface of the cam journal 24. When the cam shafts 21A and 21B rotate on the axis, oil film pressure of the lubricating oil occurs, and rotation of the cam journal 24 is supported by the oil film.

Figure 4:
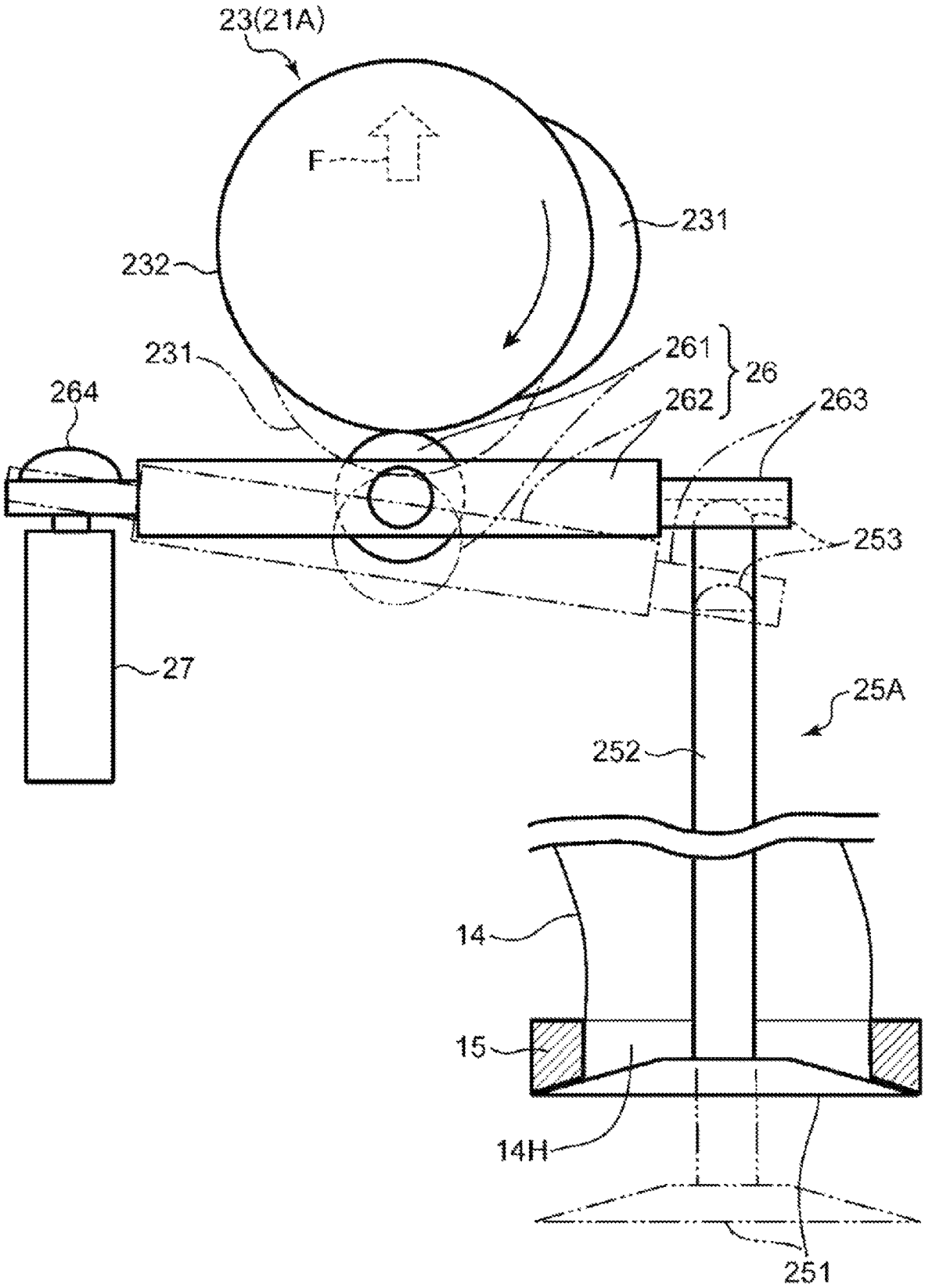
FIG. 4 is a schematic diagram illustrating a depressing operation of a valve body by a cam.

FIG. 4 is a schematic diagram illustrating a depressing operation of the intake valve 25A by the cam 23. Note that the following explanation of operation is similarly applied to the exhaust valve 25B. In FIG. 4, the circumferential surface of the cam 23 is always in contact with the circumferential surface of the roller 261 of the roller rocker arm 26 by a spring force of the valve spring 254 (not illustrated). FIG. 4 illustrates, by solid lines, a state where the base circle 232 of the cam 23 is in contact with the roller 261. In this state, the contact part 263 of the swing arm 262 does not substantially push the stem end 253 of the intake valve 25A. Therefore, the valve head 251 of the intake valve 25A is in contact with a valve seat 15, and the port opening 14H of the intake port 14 is closed.

When the cam 23 advances the rotation in the clockwise direction from the state of FIG. 4, the cam lobe 231 of the cam 23 becomes in a state of touching the roller 261, as illustrated by two-dot chain lines in this drawing. In this state, the roller 261 is pushed down by an amount of the cam lift, and the swing arm 262 inclines downwardly using the pivot part 264 as a pivot axis. By this inclination operation, the contact part 263 depresses the stem end 253 below. Therefore, the valve head 251 separates downwardly from the valve seat 15, enters into the cylinder 13, and opens the port opening 14H. Here, as illustrated by a broken-line arrow in FIG. 4, a depressing load F of the intake valve 25A acts on a position of the cam 23 which opposes to the cam lobe 231 in the circumferential direction. The depressing load F is further described.

Depressing Load of Valve Body and its Influences

Figure 5A:
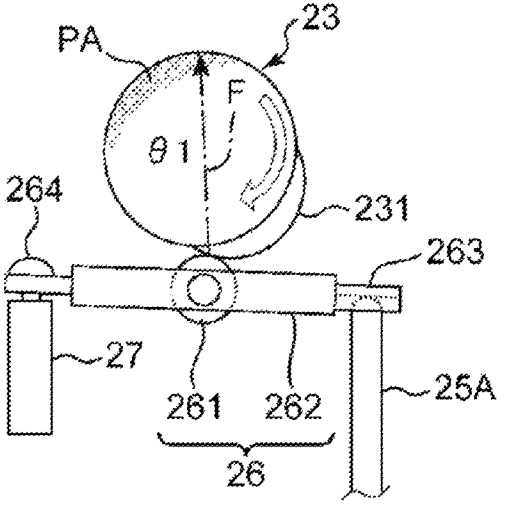
FIGS. 5A to 5C are views illustrating temporally the depressing operation of the valve body by the cam.
Figure 5B:
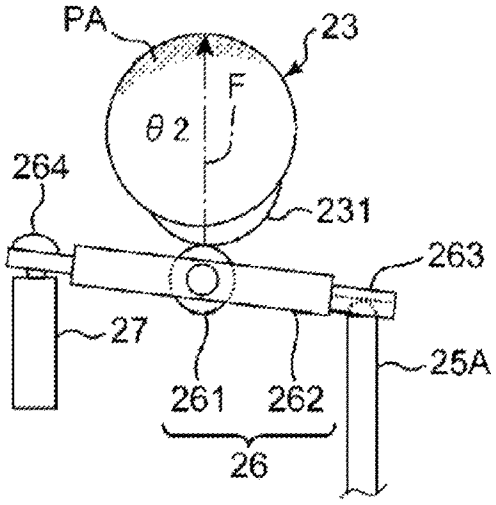
Figure 5C:
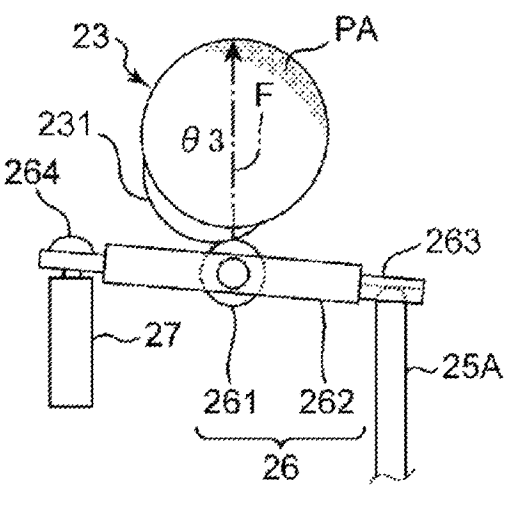
Figure 5D:
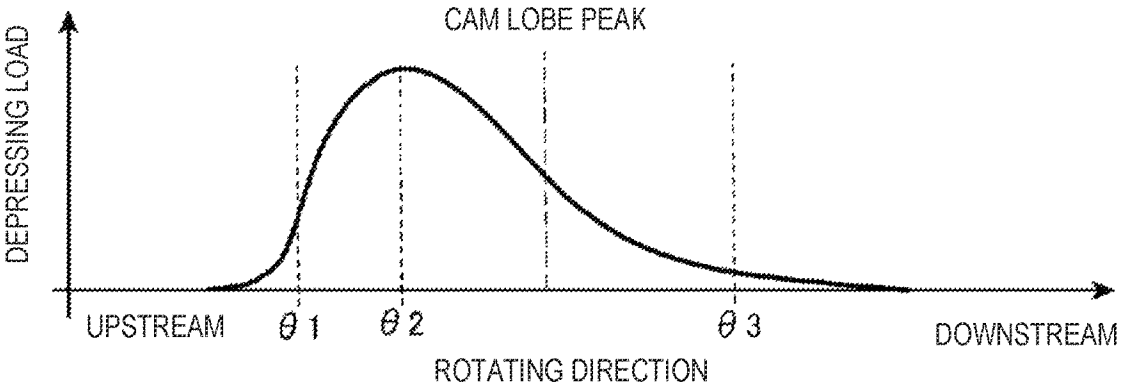
FIG. 5D is a graph illustrating a depressing load applied to the cam.

FIGS. 5A to 5C are views illustrating temporally the depressing operation of the intake valve 25A by the cam lobe 231 of the cam 23, and FIG. 5D is a graph illustrating the depressing load F applied to the cam 23. FIG. 5A illustrates a state of an early stage of the contact when the cam lobe 231 begins to contact the roller 261 (the phase of the cam shaft 21A in the rotational direction=θ1). From the contact position of the cam lobe 231 with the roller 261, the depressing load F acts toward the opposite side of the cam 23 in the radial direction. As illustrated in FIG. 5D, the early stage of contact is a period where the depressing load F becomes increases rapidly. This is because the cam 23 requires a comparatively large pressing force for starting the depression of the intake valve 25A.

FIG. 5B illustrates a state of the first half in the middle stage of contact where the contact of the cam lobe 231 with the roller 261 has progressed (the phase in the rotational direction=θ2). The swing arm 262 pivots downwardly comparatively greatly using the pivot part 264 as a pivoting fulcrum, and the contact part 263 depresses the intake valve 25A. As illustrated in FIG. 5D, this state is a state where, before the peak of the cam lobe 231 contacts the roller 261, the depressing load F is the maximum load.

FIG. 5C illustrates a state in the second half of the contact where the contact of the cam lobe 231 with the roller 261 is close to the end (the phase in the rotational direction=θ3). After the phase=θ2, the depressing load F decreases gently. After the peak of the cam lobe 231, since the intake valve 25A operates in the rising direction, the depressing load F tends to decrease more gently. When the rotation further advances and the engagement between the cam lobe 231 and the roller 261 are released, the depressing load F disappears.

FIGS. 5A to 5C each illustrate a cam high load part PA at which the depressing load F acts on the cam 23 due to the contact of the cam lobe 231 with the roller 261. The cam high load part PA occurs in the cam 23 at a location opposing the cam lobe 231 in the circumferential direction (in other words, a location opposing the cam lobe 231 with respect to the axial center part of the cam shaft 21A). In this drawing, the cam high load part PA is indicated by a crescent shape. This is because, in order to schematically illustrate a distribution of the depressing load F, the depressing load F is drawn thicker in the thickness in the radial direction as the depressing load F increases. Note that the cam high load part PA does not actually has the simple crescent-shaped load distribution, but it has a load distribution in which the load center of gravity is eccentric to the upstream side in the rotational direction as illustrated in FIG. 5D.

Figure 6:
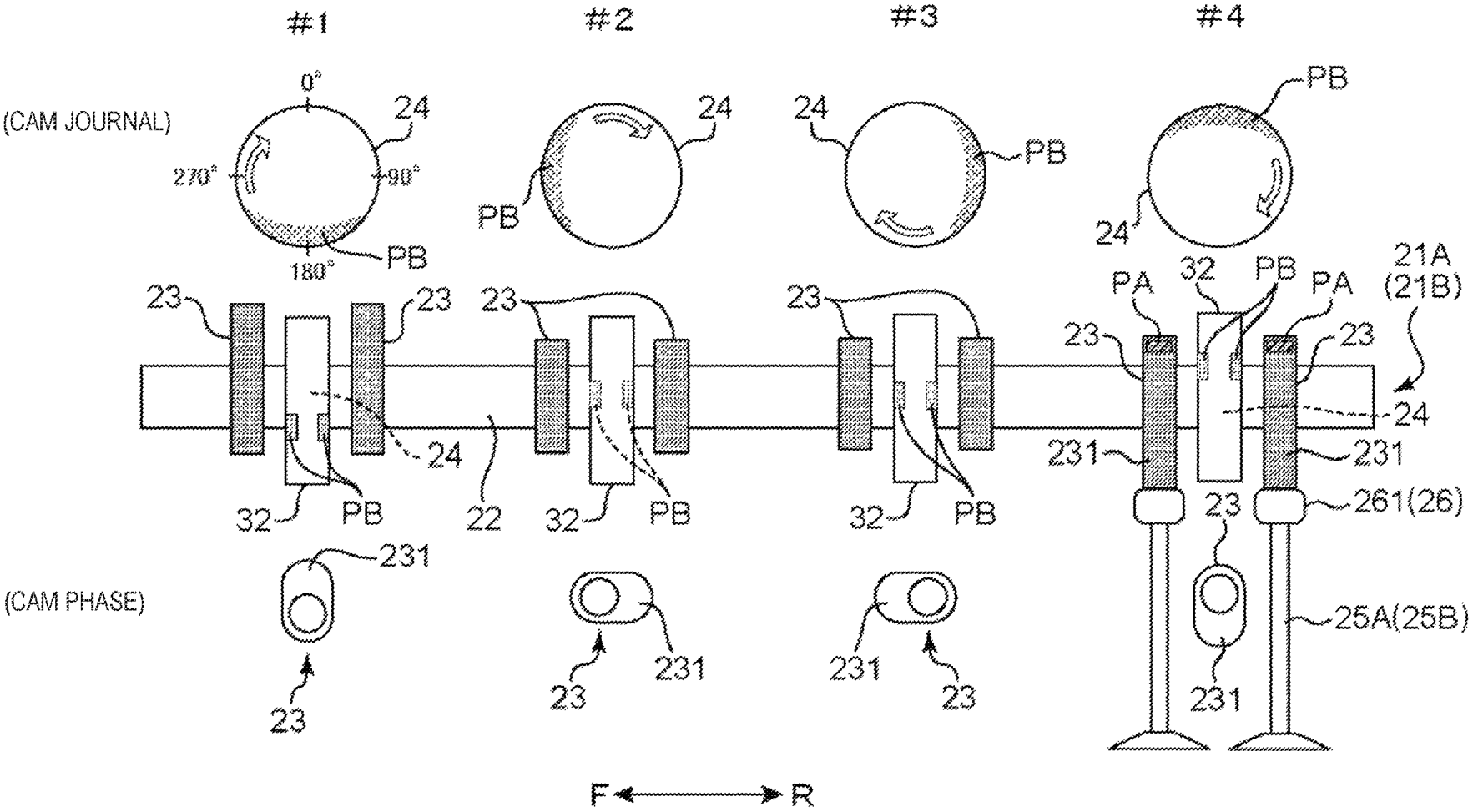
FIG. 6 is a view illustrating one example of the cam shaft, where a relationship between a rotation phase of the cam and a position of the depressing load of the valve body applied to the cam journal is illustrated.

FIG. 6 is a view schematically illustrating the cam shaft 21A for the intake valves (cam shaft 21B for exhaust valves) illustrated in FIGS. 1 to 3, where a relationship between the rotation phase of the cam 23 and the position of the depressing load of the intake valve 25A (exhaust valve 25B) applied to the cam journal 24 is illustrated. The numbers #1 to #4 in the drawing indicate the four cylinders 13 lined up in the engine front-and-rear direction F-R. As described above, in the cam shaft 21A for the intake valves, the two cams 23 are disposed for each of the #1 to #4 cylinders of four-valve type, and the cam journal 24 is disposed between the two cams 23.

As a result of having such an arrangement relationship, the cam journal 24 is disposed in an area of the shaft body 22, close to the cam 23 (cam lobe 231). Here, the "close area" is an area where the deforming force acts on the shaft body 22 due to the depressing load F received by the cam 23. For example, as illustrated in FIG. 2, the fact that the axial interval between the cam journal 24 and the cam 23 is about the axial width of one cam 23 is a typical example of the "close area."

FIG. 6 illustrates a state where the intake valves 25A corresponding to the #4 cylinder are depressed by the cam lobes 231 via the roller rocker arms 26, and the cam lobes 231 of the #1 to #3 cylinders are located at a phase where they do not engage with the rollers 261. The depressing load F actually acts on the cam 23 of the #4 cylinder, at the cam high load part PA described above. On the other hand, the depressing load F does not act on the cam high load part PA in the cam 23 of each of the #1 to #3 cylinders.

Figure 7:
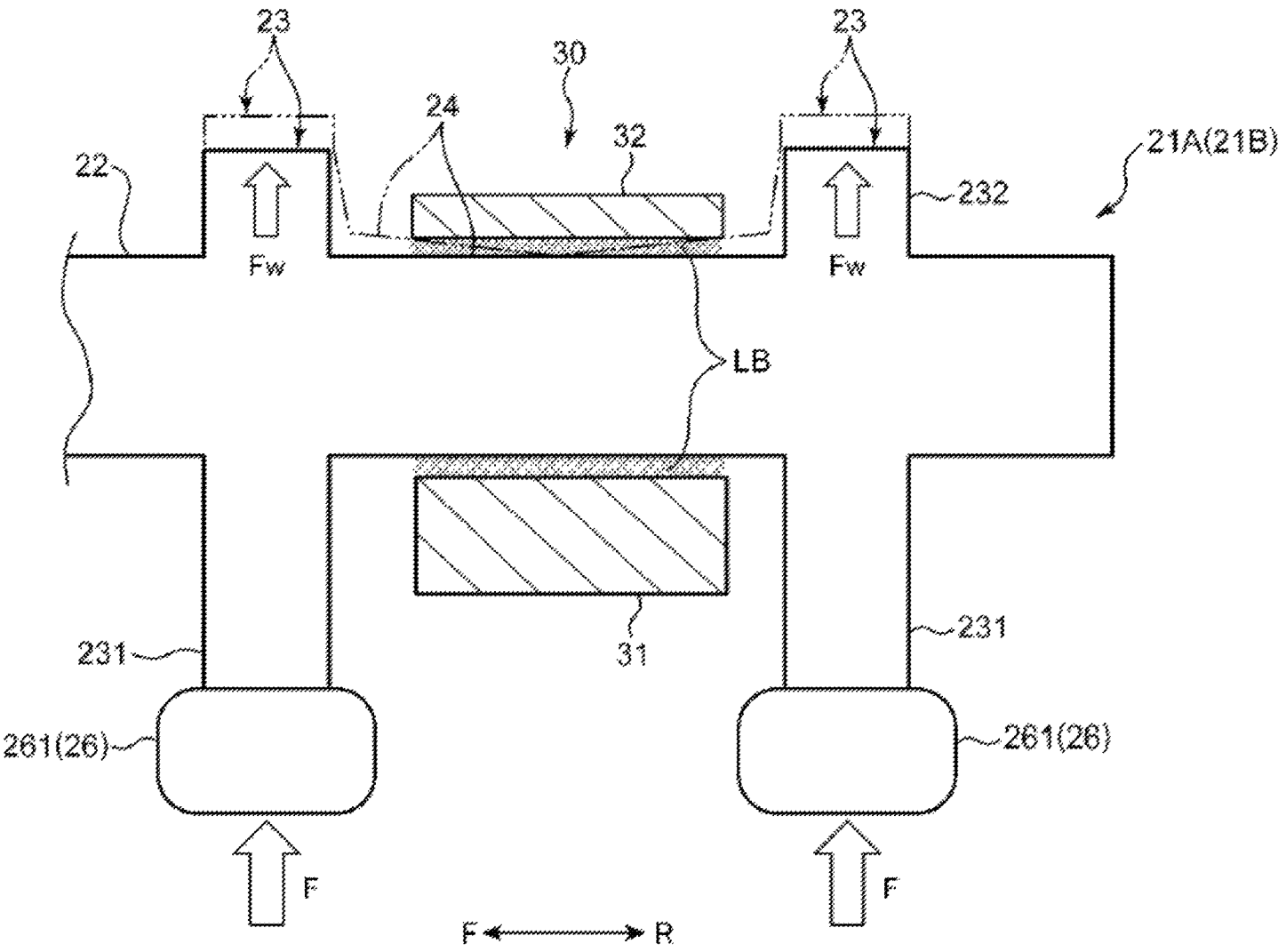
FIG. 7 is a schematic diagram illustrating a deforming situation of the cam journal when the depressing load of the valve body is applied.

When the depressing load F acts on the cam high load part PA in the cam 23, a journal high load part PB where a high load is also applied to the cam journal 24 occurs in an interlocked manner with the depressing load F. The occurring location of the journal high load part PB is a position which opposes to the cam lobe 231 in the circumferential direction, similar to the cam high load part PA. In this journal high load part PB, a deformation of the cam journal 24 originating in the depressing load F applied to the cam 23 occurs. FIG. 7 is a schematic diagram illustrating a deforming situation of the cam journal 24 when the depressing load F of the intake valve 25A is applied.

The cam journal 24 is rotatably supported by the pivotal support of the slide bearing which is created by the engagement of the head-side bearing 31 and the cam cap 32. Oil film LB of lubricating oil is formed between the inner circumferential surface of the head-side bearing 31 and the cam cap 32, and the outer circumferential surface of the cam journal 24. When the cam lobe 231 depresses the roller 261 of the roller rocker arm 26, the depressing load F acts toward the cam high load part PA which opposes to the cam lobe 231 in the circumferential direction. As illustrated by a two-dot chain line in FIG. 7, this depressing load F generates a deforming force Fw which deforms the cam shaft 21A (shaft body 22) so that the cam 23 is lifted upwardly. Note that, in FIG. 7, the deformation of the cam 23 is exaggeratingly illustrated.

Thus, when the cam 23 is deformed, the journal high load part PB occurs also in the cam journal 24 close to the cam 23, and therefore, the cam journal 24 is also deformed. In this embodiment, the cam journal 24 is disposed at the position between the pair of cams 23, and the shaft body 22 is deformed so that the pair of cams 23 are lifted upwardly. Therefore, the cam journal 24 is deformed into a bow shape so that both ends in the axial direction are raised. Such a deformation brings the outer circumferential surface the cam journal 24 near F-side and R-side end parts, close to the inner circumferential surface of the cam cap 32 which pivotally supports the annular circumferential surface of the upper half of the cam journal 24. That is, a state in which the cam journal 24 is easy to contact the cam cap 32 is formed. As for the #1 to #3 cylinders, when the phase of the cam 23 in the rotational direction becomes the same as the #4 cylinder, the deformation occurs at the journal high load part PB of the cam journal 24.

In order to suppress the mechanical resistance, it is desirable to reduce the gap between the inner circumferential surface of the head-side bearing 31 and the cam cap 32, and the cam journal 24, and to reduce the thickness of the oil film LB as much as possible. However, if the gap is reduced, the deformation of the cam journal 24 which is resulted from the depressing load F being applied to the cam 23 causes the contact of the cam journal 24 with the cam cap 32, and it increases the mechanical resistance and invites the stimulation of the wear, on the contrary. In consideration of this problem, in this embodiment, the cam journal 24 is given a geometrical devise which can avoid the contact of the cam journal 24 with the cam cap 32, while keeping the gap small as a whole. Below, this geometrical devise is described.

Cam Journal of this Embodiment

Figure 8A:
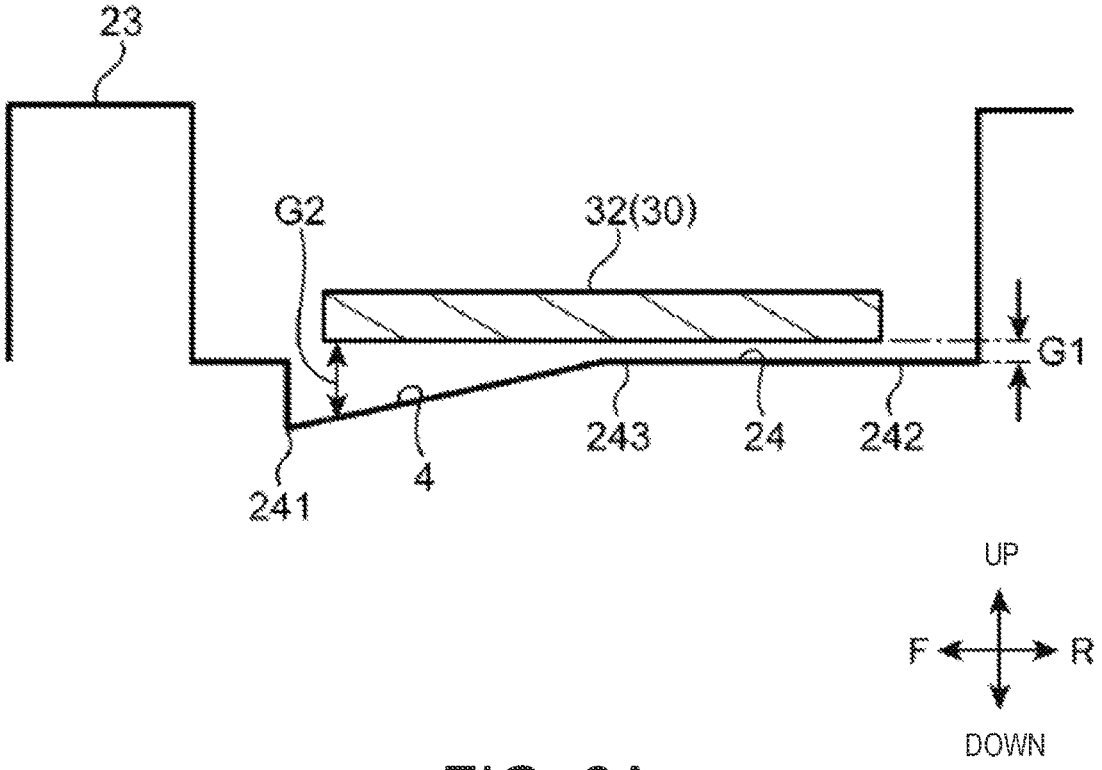
FIG. 8A is a simplified cross-sectional view illustrating one example of a recess formed in the cam journal.
Figure 8B:
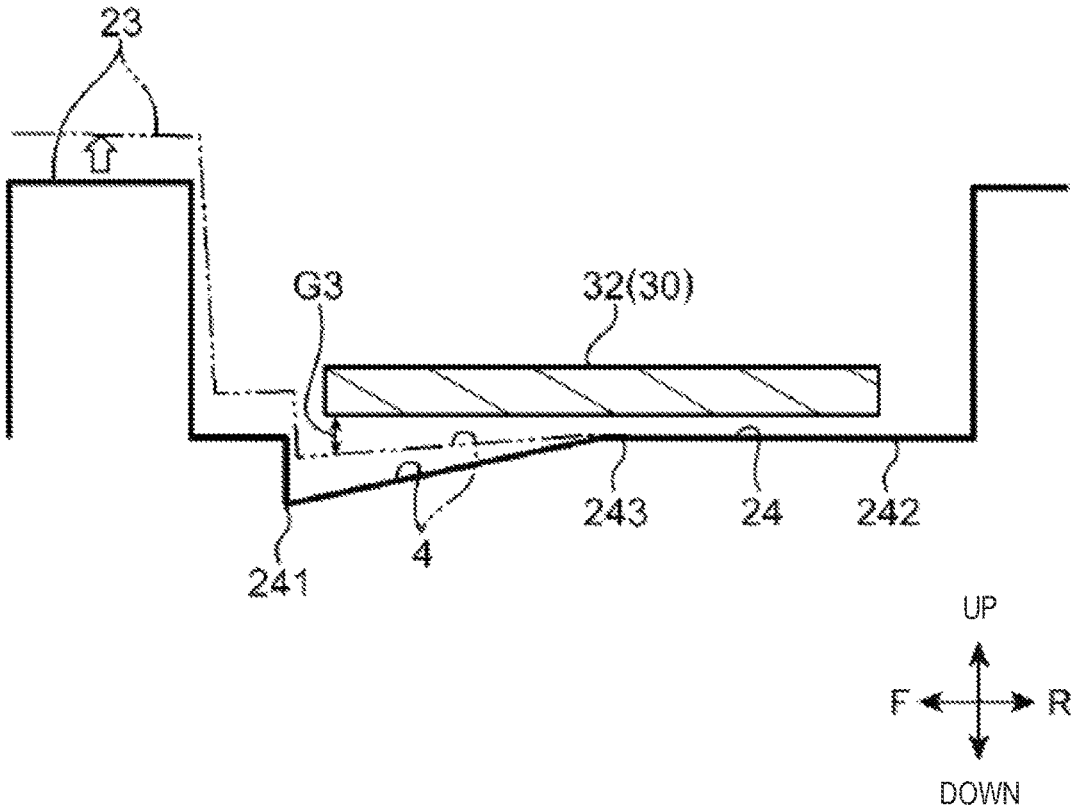
FIG. 8B is a view illustrating operation of the recess.

In this embodiment, a concrete example of the cam journal 24 in which, even if the bow-shaped deformation of the cam journals 24 occurs, the contact of the cam journal 24 with the cam cap 32 can be avoided, without spoiling the retention of the lubricating oil, is illustrated. Referring to FIGS. 8A and 8B, the cam journal 24 of this embodiment is provided with a recess 4 which is depressed radially inwardly of the cam journal 24. The recess 4 is formed in the circumferential surface of the cam journal 24 at a position which opposes to the cam lobe 231 in the circumferential direction (i.e., at a position which opposes to the protruded location of the cam lobe 231). Further, the recess 4 is deeper at an axial end part of the cam journal 24 than the axial center part.

FIG. 8A is a simplified cross-sectional view illustrating one example of the recess 4 formed in the cam journal 24, and FIG. 8B is a view illustrating operation of the recess 4. Here, suppose that the cam lobe 231 of the cam 23 close to the F-side of the cam journal 24 is located at a phase where it receives the depressing load F. In this case, the journal high load part PB as illustrated in FIG. 6 occurs in an area on the F-side of the cam journal 24, which is opposite from the cam lobe 231. The recess 4 is formed so that the part corresponding to such an area is depressed.

The recess 4 has a cross-sectional shape having such an inclination that the depth becomes gradually deeper from an axial center part 243 of the cam journal 24 toward an F-side end part 241 (axial end part). That is, in the F-side end part 241, the recess 4 is depressed the deepest radially inwardly. As illustrated in FIG. 7, when the depressing load F is applied to the cam 23, the F-side end part 241 of the cam journal 24 is deformed in a direction closest to the cam cap 32, at the position which opposes to the cam lobe 231 in the circumferential direction, and the deformation decreases as it goes toward the axial center. That is, the deformation near the F-side end part 241 becomes the largest. The recess 4 has a depth distribution which matches with such a deformation of the cam journal 24. Note that, in FIGS. 8A and 8B, the depth of the recess 4 is exaggeratingly illustrated, and the actual depth of the deepest part of the recess 4 is about several microns to about tens of microns.

FIG. 8A illustrates clearances G1 and G2 between the inner circumferential surface of the cam cap 32 and the outer circumferential surface of the cam journal 24. The clearance G1 at the part closer to an R-side end part 242 where the recess 4 is not formed is set as the standard clearance which is determined in consideration of the viscosity, etc. of the lubricating oil of the slide bearing. On the other hand, the clearance G2 at the part closer to the F-side end part 241 where the recess 4 is set to be larger than G1, and it becomes the largest at the F-side end part 241.

FIG. 8B illustrates, by a two-dot chain line, the deformation of the cam 23 and the cam journal 24 (recess 4) when the depressing load F is applied. As described above, when the depressing load F is applied to the cam 23, the shaft body 22 is deformed so that the cam 23 is lifted upwardly. As following this deformation, the part closer to the F-side end part 241 of the cam journal 24 is deformed in a direction approaching to the cam cap 32. Even if such a deformation occurs, since the recess 4 exists, a clearance G3 between the cam journal 24 and the cam cap 32 is secured. Therefore, the contact therebetween can be avoided.

The recess 4 is not formed throughout the circumference of the part closer to the F-side end part 241 of the cam journal 24, but it is formed so that only the part corresponding to the journal high load part PB is depressed. Forming the recess 4 in the cam journal 24 expands the clearance with the opposing cam cap 32, which may allow leaking of the lubricating oil from the clearance. In this embodiment, the recess 4 is formed only in the part corresponding to the journal high load part PB, and in the area where the recess 4 is not formed, the standard clearance G1 is set between the circumferential surface of the cam journal 24 and the cam cap 32. Therefore, the oil leak can be minimized.

Further, the recess 4 has the profile where the depth becomes gradually deeper from the axial center part 243 of the cam journal 24 toward the F-side end part 241. Also in this regard, a devise is made so as to prevent the unintentional expansion of the clearance. Therefore, for example, even if the low-viscosity oil of 0W8 class is used as the lubricating oil, it is difficult to cause the oil leak, thereby securing the lubrication. Therefore, it is possible to achieve both the lubrication retention in the cam cap 32 (bearing member 30), and the wear prevention of the cam journal 24.

Layout and Concrete Shape of Recess: First Embodiment

Figure 9:
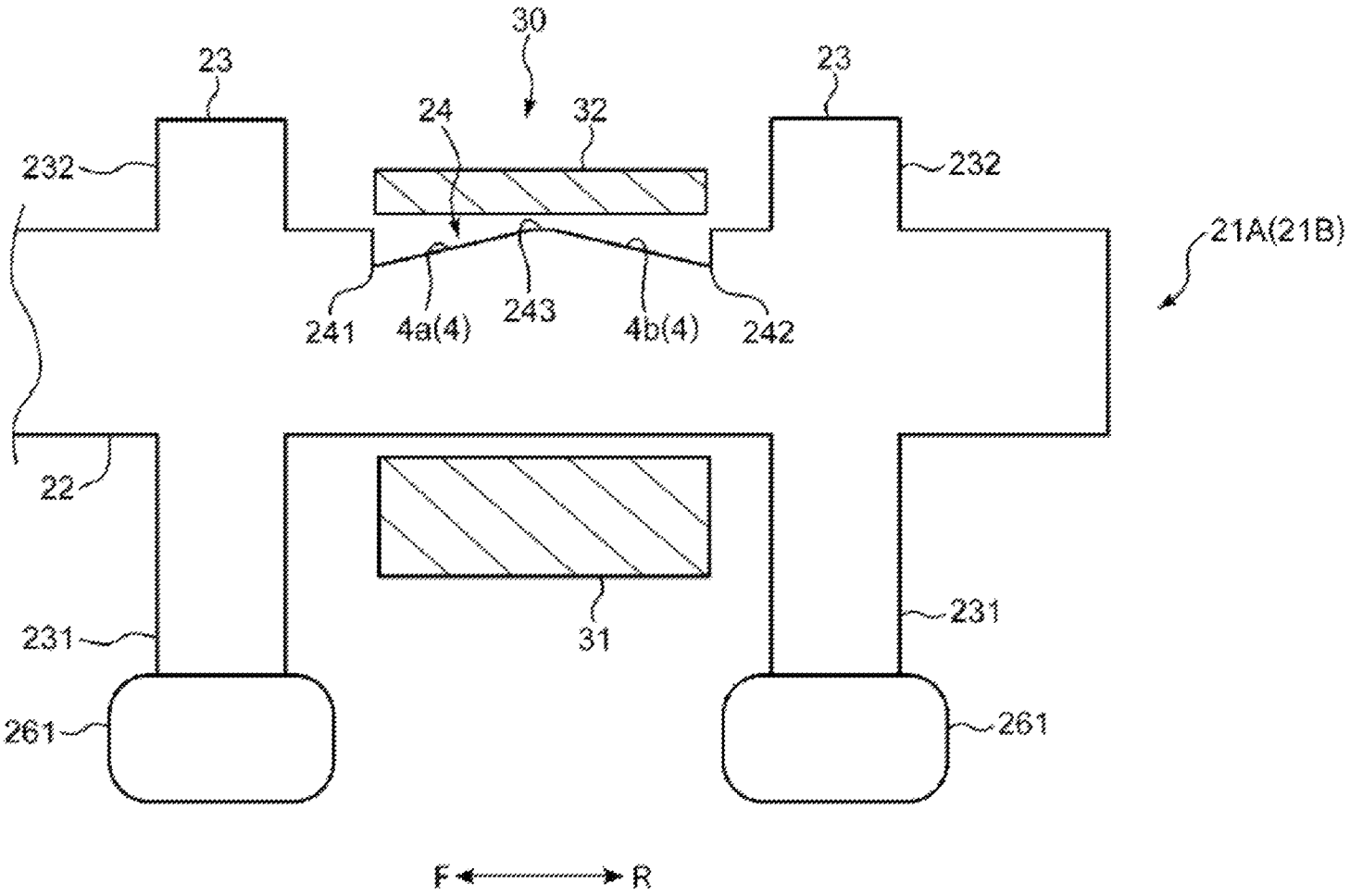
FIG. 9 is a cross-sectional view illustrating a cam shaft according to a first embodiment of the present disclosure.

Next, the layout of the recess 4 with respect to the cam shafts 21A and 21B, and the concrete shape of the recess 4 are described. The recess 4 is formed at the position corresponding to the journal high load part PB of the cam journal 24 illustrated in FIG. 6. FIG. 9 is a cross-sectional view illustrating the cam shafts 21A and 21B according to a first embodiment. FIG. 9 illustrates a formation of the cam journal 24 and the bearing member 30 corresponding to the #4 cylinder of FIG. 6, the cam 23 close to the cam journal 24 and the bearing member 30, and the recess 4. As for the #1 to #3 cylinders, a similar recess 4 is formed in the journal high load part PB.

The cam journal 24 of the cam shaft 21A for the intake valves illustrated in FIGS. 6 and 9 is disposed between a pair of cams 23. The F-side cam lobe 231 (first cam lobe) depresses the intake valve 25A (first valve body) which opens and closes the first intake port 14A (see FIG. 2), and the R-side cam lobe 231 (second cam lobe) depresses the intake valve 25A (second valve body) which opens and closes the second intake port 14B (see FIG. 2). The cam shaft 21B for the exhaust valves has a similar configuration. The cam journal 24 is disposed at the position close to and between both the F-side cam lobe 231 and the R-side cam lobe 231.

By such an arrangement, the journal high load part PB occurs at the positions of the cam journal 24 which oppose to the F-side cam lobe 231 and the R-side cam lobe 231 in the circumferential direction. Therefore, as the recess 4, a first recess 4*a* is formed at the F-side of the cam journal 24, and a second recess 4*b* is formed at the R-side. The first recess 4*a* has a shape in which it is the deepest in the F-side end part 241 of the cam journal 24, and becomes shallower gradually toward the axial center part 243. The second recess 4*b* has a shape in which it is the deepest in the R-side end part 242, and becomes shallower gradually toward the axial center part 243. By such an arrangement, even if the depressing load F is applied to the cam shafts 21A from the F-side cam lobe 231 and the R-side cam lobe 231, the clearance between the circumferential surface of the cam journal 24 and the cam cap 32 can be secured by the first recess 4*a* and the second recess 4*b*.

Figure 10A:
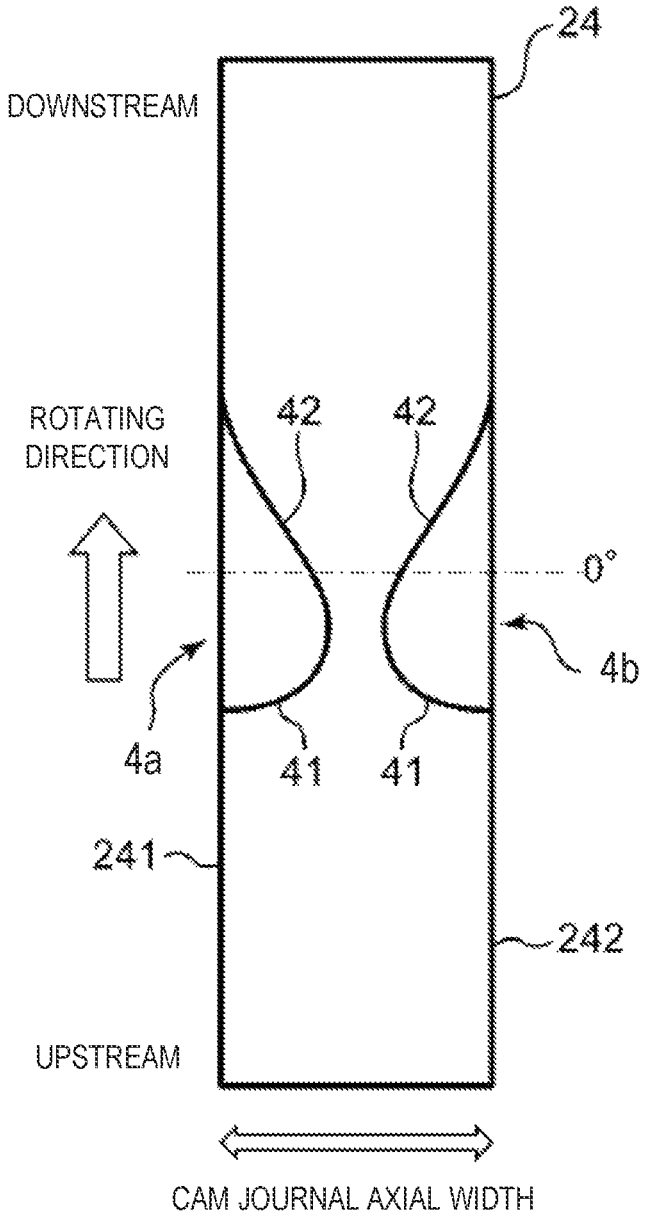
FIG. 10A is a developed view of the cam journal surface, illustrating an axial profile of the recess.

Next, the concrete shape of the recess 4 is described. FIG. 10A is a developed view of the surface of the cam journal 24, illustrating the axial profile of the recess 4 (i.e., a view illustrating a plane shape where the cam journal 24 is developed in the circumferential direction). The recess 4 has a given axial width and a given circumferential width in the axial direction (width direction) and in the circumferential direction (rotational direction) of the cam journal 24. The axial width of the recess 4 has a shape where the upstream side in the rotational direction of the cam journal 24 (cam shafts 21A and 21B) is wider than the downstream side. That is, when the plan view shape of the recess 4 is divided into two, the upstream side and the downstream side in the rotational direction (synonymous with the first half and the second half in the rotational direction), the recess 4 has a comparatively wider axial width at the upstream side than the downstream side. Note that the axial width is a dimension from the F-side end part 241 or the R-side end part 242 of the cam journal 24 to the edge of the recess 4 at the axial center side. Further, the circumferential width is a dimension of the recess 4 in the rotational direction.

In more detail, in the plan view shape when the cam journal 24 is developed in the circumferential direction, the recess 4 has a droplet shape provided with a bulged part 41 upstream in the rotational direction, and a gradual-curve part 42 downstream in the rotational direction. The bulged part 41 is a part which is bulged toward the axial center part with a tight curve near the upstream end in the rotational direction of the circumferential width of the recess 4. The gradual-curve part 42 is a gradually curved part from the bulged part 41 to the downstream end in the rotational direction of the circumferential width. That is, the edge of the recess 4 at the axial center side has a curve shape in which it rises steeply from the upstream end in the rotational direction to the F-side end part 241 or the R-side end part 242, reaches the peak position where the width becomes the maximum in an area upstream in the rotational direction, and then gently approaches the F-side end part 241 or the R-side end part 242.

Such a plan view shape of the recess 4 corresponds to the distribution of the depressing load F applied to the cam 23 illustrated in FIG. 5D. The distribution of the depressing load F has a droplet-shaped distribution in which there is a peak at the phase (=θ2) upstream in the rotational direction of the contact point of the peak of the cam lobe 231 with the roller 261, and the load center of gravity is eccentric to the upstream side in the rotational direction. That is, there is a tendency in which the largest depressing load F is applied to the cam 23 near the upstream end in the rotational direction, and the depressing load F decreases gradually as it goes toward the downstream end in the rotational direction. Such a load tendency appears in the cam high load part PA (see FIG. 6) of the cam 23, and following this, a similar load tendency appears also in the journal high load part PB of the cam journal 24. Therefore, the journal high load part PB has a droplet distribution in which the load center of gravity is eccentric to the upstream side in the rotational direction. The axial profile of the recess 4 also has a droplet shape where the width becomes larger at the upstream side in the rotational direction so as to meet such a load tendency of the journal high load part PB. Therefore, the contact of the cam journal 24 with the cam cap 32 can be certainly prevented.

Figure 10B:
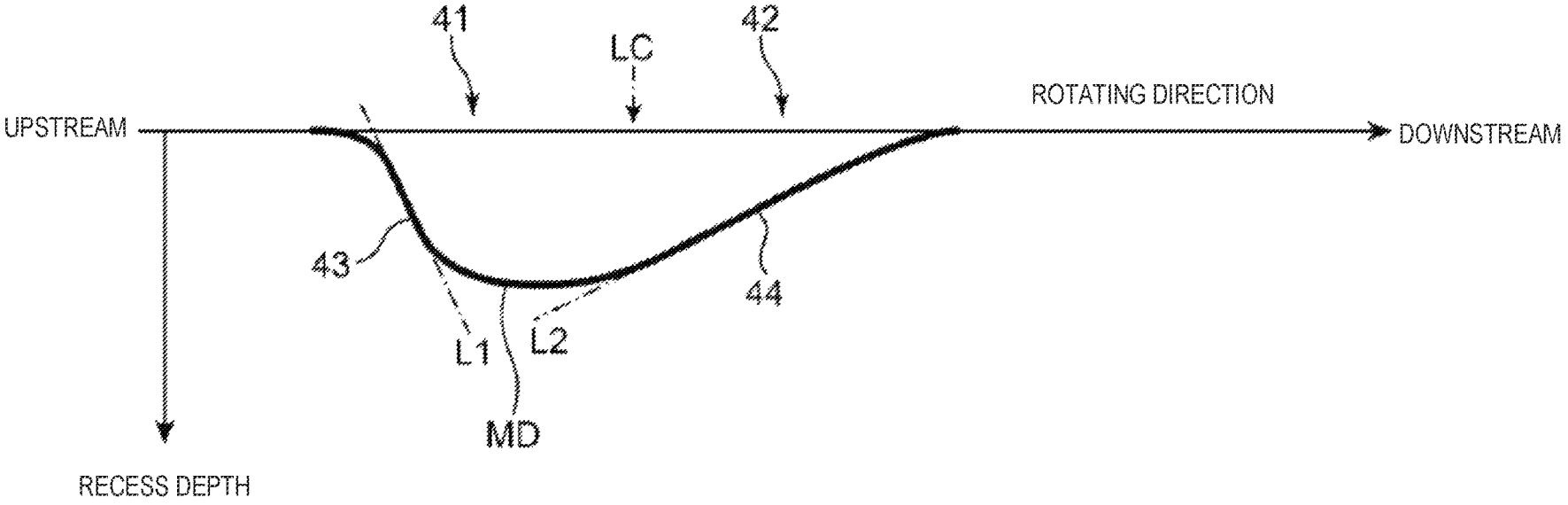
FIG. 10B is a developed view of the cam journal surface, illustrating a depth profile of the recess.

The depression depth of the recess 4 is also set so as to meet the load tendency of the journal high load part PB. That is, the depth of the recess 4 becomes deeper as the applied load to the cam journal 24 increases. FIG. 10B is a developed side view of the cam journal 24, illustrating the depth profile of the recess 4 in the rotational direction. This profile is a depth profile of the recess 4 in the F-side end part 241 or the R-side end part 242. Note that this profile also exaggerates the size in the depth direction.

The recess 4 is provided with an upstream inclined part 43 located upstream in the rotational direction, and a downstream inclined part 44 located downstream in the rotational direction, as the depression shape. The upstream inclined part 43 has a slope in which it becomes deeper at a first inclination L1 from the upstream end in the rotational direction of the circumferential width of the recess 4 toward a center part LC in the rotational direction. A deepest part MD of the recess 4 is located upstream of the center part LC in the rotational direction. The downstream inclined part 44 has a slope which becomes shallower at a second inclination L2 from the deepest part MD toward the downstream end in the rotational direction. A relationship between the first inclination L1 and the second inclination L2 is L1>L2, when both the inclination directions oriented in the same direction. That is, the recess 4 has the depression shape in which it becomes deeper steeply at the upstream side in the rotational direction, and becomes shallower gently at the downstream side of the deepest part MD. For example, when L1 and L2 are compared as angles formed with the tangent of the circumferential surface of the cam journal 24, L1 is about 1.2 to 3 times of L2.

According to the present inventors' analysis, the energy loss due to the direct contact of the cam journal 24 with the cam cap 32 accompanying the deformation of cam shafts 21A and 21B presents a characteristic in which it rises comparatively steeply in the first half of the contact, and descends comparatively gradually in the second half. Since the direct contact becomes the factor of the wear of the cam journal 24, the wear is major in the first half of the contact, and minor in the second half. Therefore, by forming in the cam journal 24 the recess 4 having the depth profile comprised of the first inclination L1 and the second inclination L2, the contact wear prevention adapted to the energy loss characteristic can be provided.

When the depth profile in the rotational direction of the recess 4 illustrated in FIG. 10B is associated with the axial profile illustrated in FIG. 10A, it becomes a relationship that the depth in the axial end part (the F-side end part 241 or the R-side end part 242) of the recess 4 becomes deeper as the axial width of the recess 4 increases. Note that the depth profile in the axial direction is similar to the basic example illustrated in FIG. 8A in that the recess 4 becomes gradually deeper from the axial center part (the droplet edge) toward the F-side end part 241 or the R-side end part 242.

That is, the depth profile of the recess 4 is set in accordance with the load distribution of the journal high load part PB so that the part where the load is large is comparatively deep, and the part where the load is small is comparatively shallow. According to this embodiment, the part of the recess 4 with the long axial width and the deep depression is disposed at the part of the cam journal 24 where the largest depressing load F is received. Therefore, the wear due to the contact of the cam journal 24 with the cam cap 32 can be securely avoided.

Layout and Concrete Shape of Recess: Second Embodiment

Figure 11:
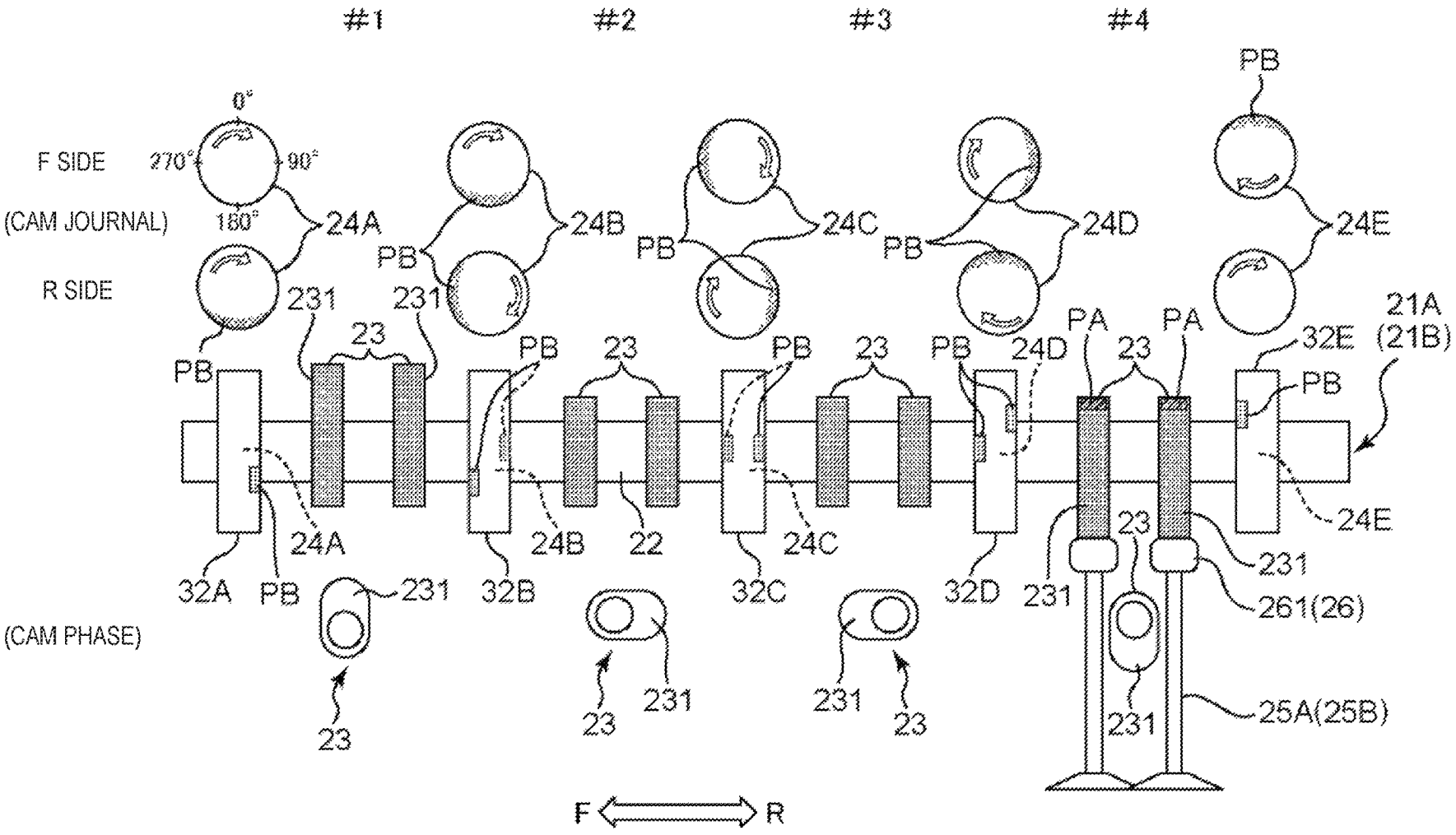
FIG. 11 is a view illustrating one example of the cam shaft, where a relationship between a rotation phase of the cam and a position of the depressing load of the valve body applied to the cam journal is illustrated.

Next, one example which applies the present disclosure to cam shafts 21A and 21B of different type from FIG. 6 is described. FIG. 11 is a view schematically illustrating the cam shaft 21A for the intake valves (the cam shaft 21B for the exhaust valves) of a different type, where a relationship between the rotation phase of the cam 23 and the position of the depressing load F applied to the cam journal 24 is illustrated. The numbers #1 to #4 in the drawing indicate the four cylinders 13 lined up in the engine front-and-rear direction F-R. It is the same as the example of FIG. 6 in that the two cams 23 are disposed for each of the #1 to #4 cylinders of four-valve type. It is different from FIG. 6 in that, in the cam shaft 21A of FIG. 11, the cam journals 24 (cam caps 32) are disposed so as to sandwich the two cams 23.

The shaft body 22 of the cam shaft 21A is provided with four pairs of cams 23 (the first cam lobe and the second cam lobe) which depresses the pair of intake valves 25A provided to each of the #1 to #4 cylinders. Further, the shaft body 22 is provided with first to fifth cam journals 24A, 24B, 24C, 24D, and 24E which are disposed so as to sandwich the pair of cams 23. Upper-half surfaces of the five cam journals 24A-24E are pivotally supported by cam caps 32A, 32B, 32C, 32D, and 32E, respectively. FIG. 11 illustrates a state where the intake valve 25A corresponding to the #4 cylinder is depressed by the cam lobe 231 via the roller rocker arm 26, and as for the #1 to #3 cylinders, the cam lobe 231 is located at a phase where it does not engage with the roller 261. That is, the depressing load F actually acts only on the cam high load part PA of the cam 23 of the #4 cylinder.

The cam shaft 21A illustrated in FIG. 6 has a structure where one cam journal 24 is sandwiched by the pair of cams 23 of one of the #1 to #4 cylinders. Therefore, two journal high load parts PB created by the cam high load part PA of the pair of cams 23 appear in the same phase part of the circumferential surface of the cam journal 24. However, in the cam shaft 21A of FIG. 11, the two journal high load parts PB sometimes appear in the different phase parts of the circumferential surface of the cam journal 24, or only one journal high load part PB sometimes appear.

In the arrangement direction of the #1 to #4 cylinders, as for the first cam journal 24A on the most F-side, the journal high load part PB occurs only at the R-side of the first cam journal 24A in the part which opposes in the circumferential direction to the cam lobe 231 (first cam lobe) of the F-side cam 23 of the #1 cylinder (180° position in the circumferential direction). On the other hand, as for the fifth cam journal 24E on the most R-side, the journal high load part PB occurs only at its F-side in the part which opposes in the circumferential direction to the cam lobe 231 (second cam lobe) of the R-side cam 23 of the #4 cylinder (0° position in the circumferential direction).

On the other hand, as for the second cam journal 24B which is the second one from the most F-side, it receives the influence of the depressing load F from the R-side cam 23 of the #1 cylinder and the F-side cam 23 of the #2 cylinder with different projection phases of the cam lobe 231. Therefore, the journal high load part PB may occur at the F-side and the R-side of the second cam journal 24B, in the part which opposes in the circumferential direction to the cam lobe 231 of each cam 23. In the example of FIG. 11, the 180° position in the circumferential direction at the F-side of the second cam journal 24B, and the 270° position in the circumferential direction at the R-side become occurrence scheduled parts of the journal high load part PB. As for the third and fourth cam journals 24C and 24D, the journal high load part PB appears at the F-side and the R-side, at different positions in the circumferential direction, similar to the second cam journal 24B.

Figure 12:
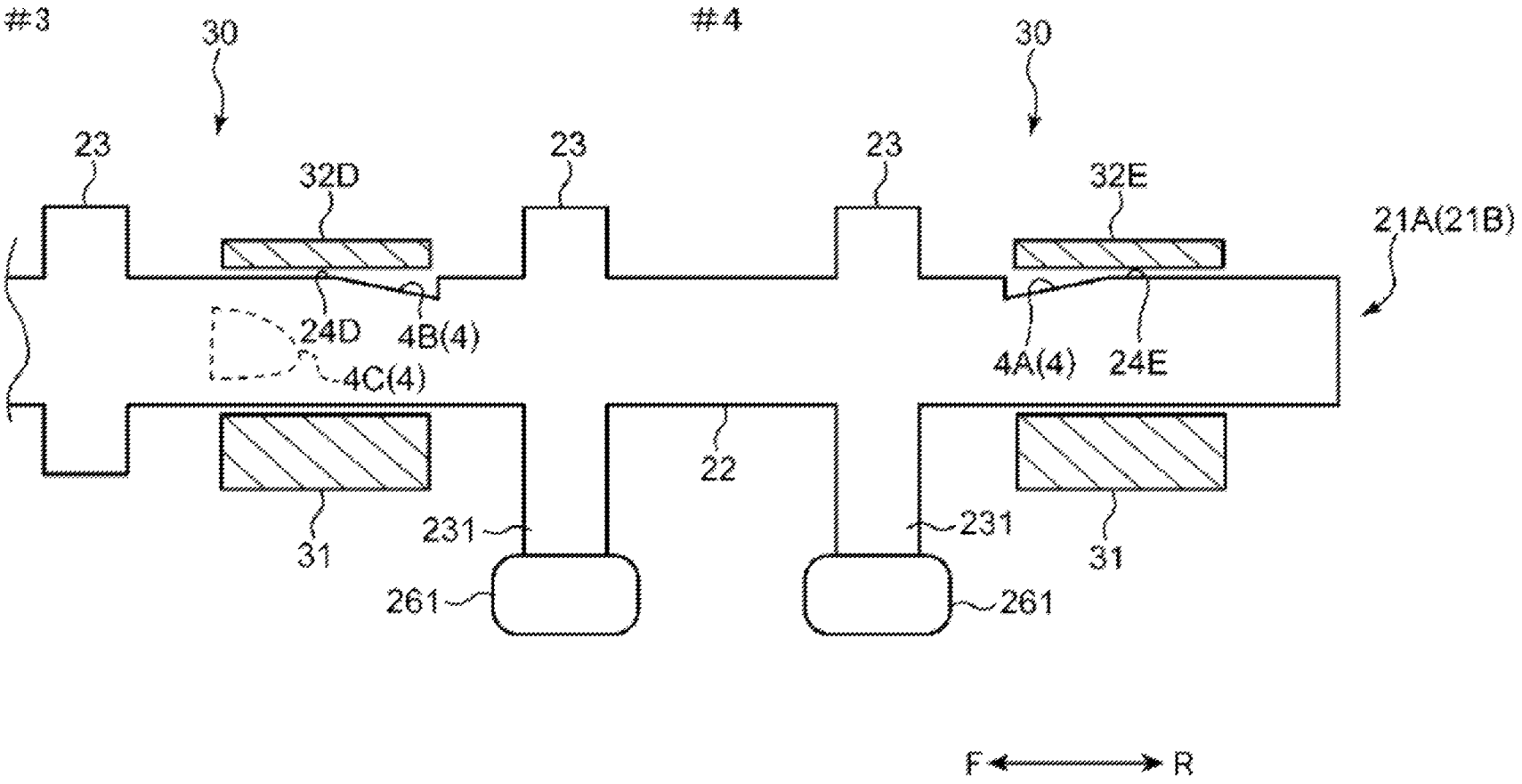
FIG. 12 is a cross-sectional view illustrating a cam shaft according to a second embodiment of the present disclosure.

FIG. 12 is a cross-sectional view illustrating the cam shaft 21A (21B) according to a second embodiment. In FIG. 12, a pair of cams 23 corresponding to the #4 cylinder of FIG. 11, the fourth and fifth cam journals 24D and 24E disposed so as to sandwich these cams 23 and their bearing members 30, and the formation of the recesses 4 corresponding to the fourth and fifth cam journals 24D and 24E are illustrated.

As described above, as for the fifth cam journal 24E, only the part opposite from the cam lobe 231 of the R-side cam 23 of the #4 cylinder becomes the journal high load part PB. Therefore, as the recess 4, a first recess 4A is formed only in the journal high load part PB on the F-side of the fifth cam journal 24E. The first recess 4A has a shape in which it is the deepest at the F-side end of the fifth cam journal 24E, and becomes shallower gradually toward the axial center part.

The fourth cam journal 24D receives the influence of the depressing load F from the R-side cam 23 of the #3 cylinder and the F-side cam 23 of the #4 cylinder with different projection phases of the cam lobe 231. Therefore, at the R-side of the fourth cam journal 24D, a second recess 4B is formed in the part corresponding to the opposite side of the cam lobe 231 of the F-side cam 23 of the #4 cylinder. On the other hand, at the F-side of the fourth cam journal 24D, a third recess 4C is formed in the part corresponding to the opposite side of the cam lobe 231 of the R-side cam 23 of the #3 cylinder. The second recess 4B is formed at the 0° position in the circumferential direction of the fourth cam journal 24D, and the third recess 4C is formed at the 90° position in the circumferential direction.

The recess 4 is formed for the first cam journal 24A in a mirror symmetrical manner with the fifth cam journal 24E, and the recess 4 is formed for the second and third cam journals 24B and 24C similarly to the fourth cam journal 24D. According to such an arrangement of the recess 4, even if the depressing load F is applied to the cam shaft 21A from the cam lobe 231 of each cam 23, the clearance between the circumferential surface of the cam journal 24 and the cam cap 32 can be secured by each recess 4.

Figure 13C:
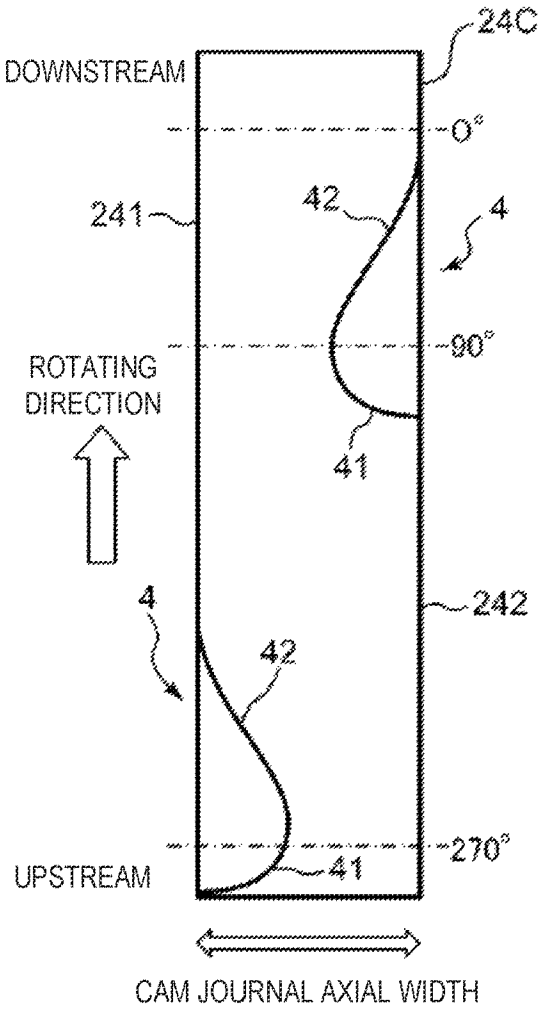
FIGS. 13A to 13C are developed views of the cam journal surface, illustrating the axial profile of the recess formed in the cam shaft of the second embodiment.
Figure 13B:
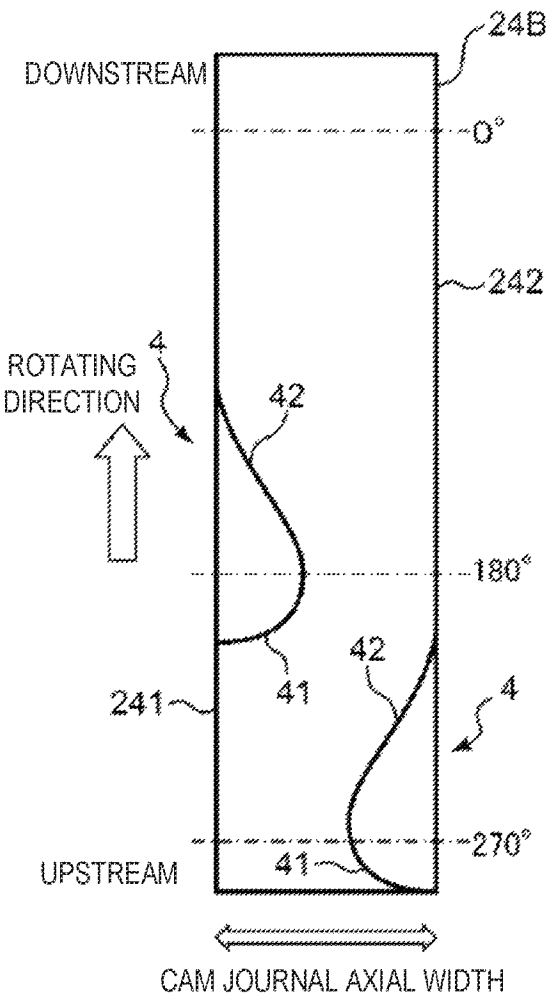
Figure 13A:
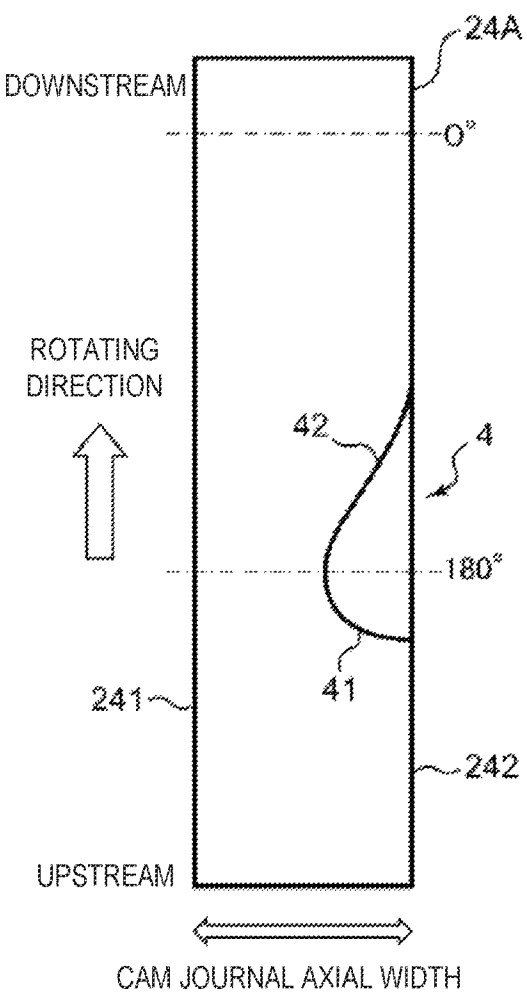

FIGS. 13A to 13C are developed views of the cam journal surface, illustrating the axial profile of the recess 4 formed in the cam shaft 21A of the second embodiment. FIG. 13A is a view illustrating the recess 4 formed in the first cam journal 24A on the most F-side as a plane shape where the recess 4 is developed in the circumferential direction. The first cam journal 24A is formed at 180° position in the circumferential direction, and is provided with one recess 4 extending from the R-side end part 242 toward the axial center part. This recess 4 has the droplet shape similar to that illustrated previously in FIG. 10A. That is, the recess 4 is comprised of the bulged part 41 located upstream in the rotational direction, and the gradual-curve part 42 located downstream in the rotational direction. The recess 4 of the fifth cam journal 24E is formed symmetrically with the first cam journal 24A with respect to the F-side end part 241. Note that the depth profile of the recess 4 is set as illustrated in FIG. 10B.

FIG. 13B illustrates the recess 4 formed in the second cam journal 24B. The second cam journal 24A is comprised of a F-side recess 4 extending toward the axial center part from the F-side end part 241, and an R-side recess 4 extending toward the axial center part from the R-side end part 242. These recesses 4 also have the droplet shape comprised of the bulged part 41 and the gradual-curve part 42. The F-side recess 4 is formed near the 180° position in the circumferential direction of the second cam journal 24B, and the R-side recess 4 is formed near the 270° position in the circumferential direction. As for the fourth cam journal 24D, the F-side and the R-side recesses 4 are formed in a similar phase relationship.

FIG. 13C illustrates the recess 4 formed in the third cam journal 24C. The third cam journal 24C is also comprised of the F-side recess 4 extending toward the axial center part from the F-side end part 241, and the R-side recess 4 extending toward the axial center part from the R-side end part 242. These recesses 4 also have the droplet shape comprised of the bulged part 41 and the gradual-curve part 42, and are disposed in the spatial relationship in which they oppose to that of the third cam journal 24C in the circumferential direction. The R-side recess 4 is formed near the 90° position in the circumferential direction of the third cam journal 24C, and the F-side recess 4 is formed near the 270° position in the circumferential direction.

According to the second embodiment described above, even if in the cam shaft 21A the journal high load part PB occurs in one cam journal 24 at the different positions in the circumferential direction on the F-side and the R-side, the clearance between each circumferential surface of the cam journal 24 and the bearing member 30 (cam cap 32) can be secured by each recess 4. Further, as for the first and fifth cam journals 24A and 24E located at the end of the cam shaft 21A, only one recess 4 corresponding to one nearby cam 23 is formed. Therefore, the clearance is not unnecessarily formed between the cam journals 24A and 24E and the bearing member 30, and both the securing of the lubrication and the prevention of the wear of the cam journal can be achieved.

Modifications

As described above, although the embodiments of the present disclosure are described, the present disclosure is not limited to the above embodiments, and may take the following modified embodiments.

(1) In the above embodiment, the cam shafts 21A and 21B corresponding to the in-series four-cylinder engine 1 are illustrated. The cam shafts 21A and 21B may be cam shafts for other multicylinder engines (for example, in-series six-cylinder engines).

Figure 14A:
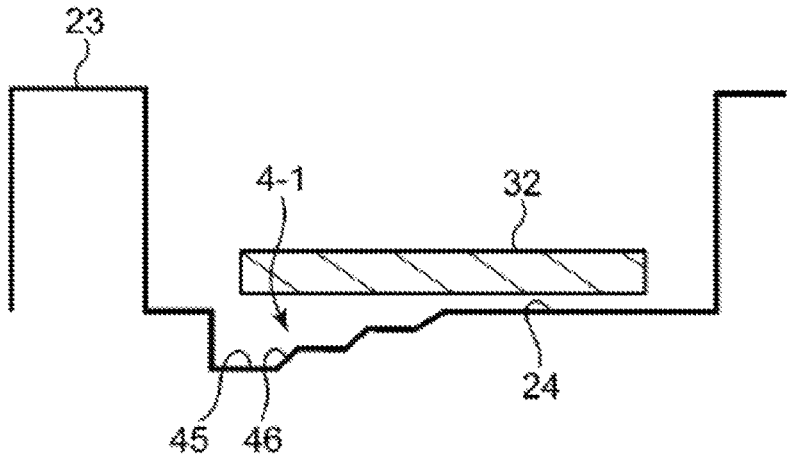
FIGS. 14A to 14C are outline cross-sectional views illustrating modifications of the recess.
Figure 14B:
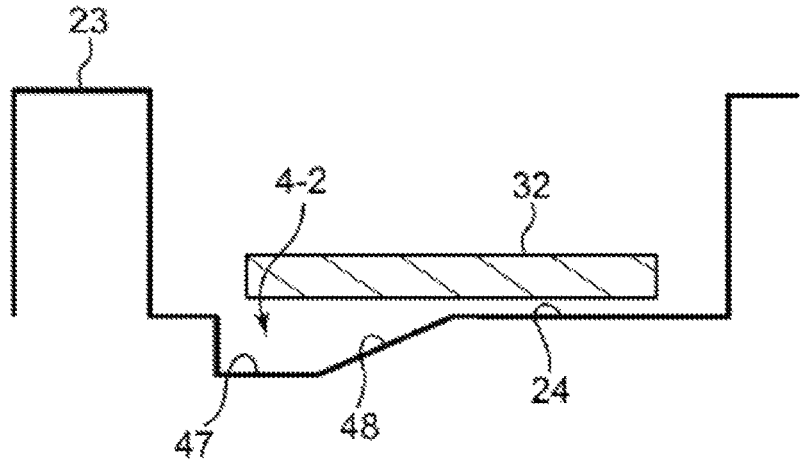
Figure 14C:
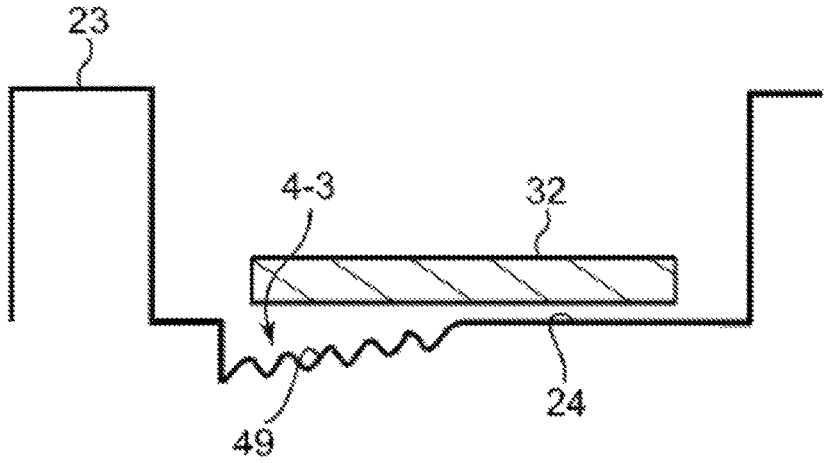

(2) In the above embodiment, the recess 4 in which the depth becomes gradually deeper from the axial center part of the cam journal 24 toward the axial end part (the F-side end part 241 or the R-side end part 242) is illustrated. The recess 4 may take various modified embodiments, as long as it satisfies a relationship where the axial end part of the cam journal 24 is deeper than the axial center part. FIGS. 14A to 14C illustrate recesses 4-1, 4-2, and 4-3 according to modifications.

FIG. 14A is an outline cross-sectional view of the cam journal 24 illustrating the recess 4-1 having a stair-type depression shape. The recess 4-1 has a depression shape in which a horizontal part 45 with no inclination and an inclined part 46 having an inclination continue alternately, and the depression depth is deeper in the axial end part of the cam journal 24 than the axial center part. FIG. 14B illustrates the recess 4-2 comprised of one horizontal part 47 and one inclined part 48. The inclined part 48 is disposed in the axial center part of the cam journal 24, and the horizontal part 47 extends from the deepest end of the inclined part 48 to the axial end part. FIG. 14C illustrates the recess 4-3 having a concavo-convex inclined part 49. The concavo-convex inclined part 49 is an inclined part which becomes deeper as the whole from the axial center part of the cam journal 24 to the axial end part, while repeating concave and convex. Such recesses 4-1, 4-2, and 4-3 have similar operation of effects to the recess 4 described above.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Engine (Internal Combustion Engine)
10 Engine Body
13 Cylinder
14 Intake Port
14H Port Opening (Opening for Intake and Exhaust)
21A Cam Shaft for Intake Valve (Cam Shaft)
21B Cam Shaft for Exhaust Valve (Cam Shaft)
23 Cam
231 Cam Lobe
24 Cam Journal
241 F-side End Part (Axial End Part)
242 R-side End Part (Axial End Part)
243 Axial Center Part
25A, 25B Intake Valve, Exhaust Valve (Valve Body)
30 Bearing Member
31 Head-side Bearing
32 Cam Cap (Bearing Member)
4 Recess
41 Bulged Part
42 Gradual-curve Part

What is claimed is:

1. An internal combustion engine, comprising:

an engine body defining at least one cylinder including at least one intake opening, at least one exhaust opening, and a plurality of valve bodies, each opening configured to be opened and closed via an associated valve body of the plurality of valve bodies;

an intake cam shaft including at least one intake cam lobe corresponding to the at least one intake opening, each intake cam lobe configured to open the corresponding intake opening by depressing the associated valve body; and an exhaust cam shaft including at least one exhaust cam lobe corresponding to the at least one exhaust opening, each exhaust cam lobe configured to open the corresponding exhaust opening by depressing the associated valve body, wherein each cam shaft further includes a plurality of cam journals corresponding to a plurality of bearing members, each cam journal configured to be pivotally supported by the corresponding bearing member via lubricating oil, wherein each cam journal includes a recess formed on a surface of the cam journal between an axial center part of the cam journal and each axial end part of the cam journal which is adjacent to a corresponding cam lobe of the at least one intake cam lobe or the at least one exhaust cam lobe, and wherein each recess extends radially inwardly at a position that is diametrically opposed to a projecting side of the corresponding cam lobe such that the recess is deeper at the axial end part than at the axial center part.

2. The internal combustion engine of claim 1, wherein in each cam journal, each recess becomes gradually deeper from the axial center part toward the axial end part.

3. The internal combustion engine of claim 2, wherein in each cam journal:

each recess has an axial width extending in an axial direction of the cam journal, and a circumferential length extending in a circumferential direction of the cam journal, and the axial width is greater on a first half side of the circumferential length in a rotational direction of the cam shaft, corresponding to a valve body opening event, than on a second half side of the circumferential length, corresponding to a valve body closing event.

4. The internal combustion engine of claim 3, wherein in each cam journal, each recess has a droplet shape in the circumferential direction such that a widest portion of the axial width forms a bulged part that is bulged toward the axial center part on the first half side of the circumferential length, and the axial width then gradually decreases toward the axial end part on the second half side of the circumferential length.

5. The internal combustion engine of claim 4, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein a corresponding cam journal of the plurality of cam journals is disposed between the first intake cam lobe and the second intake cam lobe of each cylinder, and between the first exhaust cam lobe and the second exhaust cam lobe of each cylinder.

6. The internal combustion engine of claim 4, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein the first and second intake cam lobes of each cylinder and the first and second exhaust cam lobes of each cylinder are disposed between adjacent cam journals of the plurality of cam journals.

7. The internal combustion engine of claim 3, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein a corresponding cam journal of the plurality of cam journals is disposed between the first intake cam lobe and the second intake cam lobe of each cylinder, and between the first exhaust cam lobe and the second exhaust cam lobe of each cylinder.

8. The internal combustion engine of claim 3, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein the first and second intake cam lobes of each cylinder and the first and second exhaust cam lobes of each cylinder are disposed between adjacent cam journals of the plurality of cam journals.

9. The internal combustion engine of claim 2, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein a corresponding cam journal of the plurality of cam journals is disposed between the first intake cam lobe and the second intake cam lobe of each cylinder, and between the first exhaust cam lobe and the second exhaust cam lobe of each cylinder.

10. The internal combustion engine of claim 2, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein the first and second intake cam lobes of each cylinder and the first and second exhaust cam lobes of each cylinder are disposed between adjacent cam journals of the plurality of cam journals.

11. The internal combustion engine of claim 1, wherein in each cam journal, each recess has an axial width extending in an axial direction of the cam journal, and a circumferential length extending in a circumferential direction of the cam journal, and the axial width is greater on a first half side of the circumferential length in a rotational direction of the cam shaft, corresponding to a valve body opening event, than on a second half side of the circumferential length, corresponding to a valve body closing event.

12. The internal combustion engine of claim 11, wherein in each cam journal, each recess has a droplet shape in the circumferential direction such that a widest portion of the axial width forms a bulged part that is bulged toward the axial center part on the first half side of the circumferential length, and the axial width then gradually decreases toward the axial end part on the second half side of the circumferential length.

13. The internal combustion engine of claim 11, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein a corresponding cam journal of the plurality of cam journals is disposed between the first intake cam lobe and the second intake cam lobe of each cylinder, and between the first exhaust cam lobe and the second exhaust cam lobe of each cylinder.

14. The internal combustion engine of claim 11, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein the first and second intake cam lobes of each cylinder and the first and second exhaust cam lobes of each cylinder are disposed between adjacent cam journals of the plurality of cam journals.

15. The internal combustion engine of claim 1, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein a corresponding cam journal of the plurality of cam journals is disposed between the first intake cam lobe and the second intake cam lobe of each cylinder, and between the first exhaust cam lobe and the second exhaust cam lobe of each cylinder.

16. The internal combustion engine of claim 1, wherein the at least one cylinder comprises a plurality of cylinders, each cylinder including first and second intake openings and first and second exhaust openings, wherein, for each cylinder, the intake cam shaft includes a first intake cam lobe and a second intake cam lobe corresponding to the first and second intake openings, the first and second intake cam lobes configured to respectively open the first and second intake openings by depressing the associated valve bodies, wherein, for each cylinder, the exhaust cam shaft includes a first exhaust cam lobe and a second exhaust cam lobe corresponding to the first and second exhaust openings, the first and second exhaust cam lobes configured to respectively open the first and second exhaust openings by depressing the associated valve bodies, and wherein the first and second intake cam lobes of each cylinder and the first and second exhaust cam lobes of each cylinder are disposed between adjacent cam journals of the plurality of cam journals.

* * * * *